US011350705B2

(12) United States Patent
Cheng et al.

(10) Patent No.: US 11,350,705 B2
(45) Date of Patent: Jun. 7, 2022

(54) BUCKLE ASSEMBLY

(71) Applicant: Wonderland Switzerland AG, Steinhausen (CH)

(72) Inventors: Manqun Cheng, Guangdong (CN); Zheng-Wen Guo, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 16/928,005

(22) Filed: Jul. 14, 2020

(65) Prior Publication Data

US 2021/0015217 A1 Jan. 21, 2021

(30) Foreign Application Priority Data

Jul. 17, 2019 (CN) ..... 201910648903.3
Jun. 30, 2020 (CN) ..... 202010621957.3

(51) Int. Cl.
*A44B 11/25* (2006.01)

(52) U.S. Cl.
CPC ..... *A44B 11/2519* (2013.01)

(58) Field of Classification Search
CPC ..... A44B 11/2519; A44B 11/2515; A44B 11/226; A44D 2203/00
See application file for complete search history.

(56) References Cited

U.S. PATENT DOCUMENTS 3,041,697 A 7/1962 Frances
D273,840 S 5/1984 Morita
D294,810 S 3/1988 Morita
D301,566 S 6/1989 Heiberger
D319,201 S 8/1991 Aoki
D330,509 S 10/1992 Belknap
(Continued)

FOREIGN PATENT DOCUMENTS

CN 104856373 A 8/2015
EP 3165117 B1 4/2018
(Continued)

OTHER PUBLICATIONS

Office action for related Japan Application No. 2020-121930, dated Nov. 24, 2021.

*Primary Examiner* — Robert Sandy
(74) *Attorney, Agent, or Firm* — Pilloff Passino & Cosenza LLP; Martin J. Cosenza; Sean A. Passino

(57) ABSTRACT

A buckle assembly includes a first buckle component, a second buckle component and an operating component. The first buckle component includes a locked portion. The second buckle component includes a locking portion. The locking portion engages with the locked portion along a lateral direction of the buckle assembly when the second buckle component is mated with the first buckle component along a mating direction. The operating component is partially embedded in and partially exposed out of the second buckle component. The operating component is slidable relative to the second buckle component. The operating component drives the locking portion to move away from the locked portion for disengaging the locking portion from the locked portion during a sliding movement of the operating component relative to the second buckle component. The present invention has advantage of saving labor and easy operation.

44 Claims, 20 Drawing Sheets

(56) References Cited

U.S. PATENT DOCUMENTS

| | | | |
|---|---|---|---|
| D335,266 | S | 5/1993 | Morita |
| D360,391 | S | 7/1995 | Aoki |
| D375,061 | S | 10/1996 | Morita |
| 5,630,258 | A | 5/1997 | Schneider |
| D386,669 | S | 11/1997 | Aoki |
| D400,429 | S | 11/1998 | Morita |
| D401,889 | S | 12/1998 | Wong |
| D411,478 | S | 6/1999 | Kenagy |
| D412,865 | S | 8/1999 | Aoki |
| D413,282 | S | 8/1999 | Aoki |
| D425,780 | S | 5/2000 | Aoki |
| D426,491 | S | 6/2000 | Chan |
| D426,765 | S | 6/2000 | Aoki |
| D430,483 | S | 9/2000 | Wah et al. |
| D431,453 | S | 10/2000 | Chan |
| D432,400 | S | 10/2000 | Chan |
| D434,644 | S | 12/2000 | Aoki |
| D438,451 | S | 3/2001 | Reiter |
| D439,147 | S | 3/2001 | Kenagy |
| D441,317 | S | 5/2001 | Nire |
| D441,639 | S | 5/2001 | Reiter |
| D450,625 | S | 11/2001 | Khromachou |
| D452,137 | S | 12/2001 | Aoki |
| D452,643 | S | 1/2002 | Morita |
| D452,644 | S | 1/2002 | Morita |
| D452,813 | S | 1/2002 | Morita |
| D453,105 | S | 1/2002 | Morita |
| D454,482 | S | 3/2002 | Morita |
| D456,130 | S | 4/2002 | Towns |
| D457,834 | S | 5/2002 | Morita |
| D461,116 | S | 8/2002 | Aoki |
| D461,400 | S | 8/2002 | Aoki |
| D462,255 | S | 9/2002 | Aoki |
| D464,562 | S | 10/2002 | Reiter |
| D481,298 | S | 10/2003 | Aoki |
| D482,266 | S | 11/2003 | Aoki |
| D504,311 | S | 4/2005 | Aoki |
| D506,921 | S | 7/2005 | Aoki |
| D511,449 | S | 11/2005 | Aoki |
| D518,707 | S | 4/2006 | Aoki |
| D527,618 | S | 9/2006 | Aoki |
| D527,620 | S | 9/2006 | Aoki |
| D539,132 | S | 3/2007 | Aoki |
| D555,470 | S | 11/2007 | Aoki |
| D556,032 | S | 11/2007 | Aoki |
| D558,038 | S | 12/2007 | Aoki |
| D569,717 | S | 5/2008 | Aoki |
| D570,672 | S | 6/2008 | Aoki |
| D572,579 | S | 7/2008 | Aoki |
| D581,774 | S | 12/2008 | Aoki |
| D584,601 | S | 1/2009 | Aoki |
| D584,602 | S | 1/2009 | Aoki |
| D595,123 | S | 6/2009 | Aoki |
| D618,590 | S | 6/2010 | Paik |
| D671,443 | S | 11/2012 | Paik et al. |
| D671,862 | S | 12/2012 | Metsker |
| 8,353,544 | B2 | 1/2013 | Fiedler |
| 8,359,716 | B2 | 1/2013 | Fiedler |
| 8,368,494 | B2 | 2/2013 | Fiedler |
| 8,430,434 | B2 | 4/2013 | Fiedler |
| 8,464,403 | B2 | 6/2013 | Fiedler |
| 8,484,809 | B2 | 7/2013 | Fiedler |
| 8,495,803 | B2 | 7/2013 | Fiedler |
| D691,879 | S | 10/2013 | Bernard |
| 8,739,371 | B2 | 6/2014 | Fiedler |
| 8,794,682 | B2 | 8/2014 | Fiedler |
| 8,800,117 | B2 | 8/2014 | Fiedler |
| 8,850,670 | B2 | 10/2014 | Fiedler |
| 8,851,534 | B2 | 10/2014 | Fiedler |
| 9,044,071 | B2 | 6/2015 | Fiedler |
| 9,096,148 | B2 | 8/2015 | Fiedler |
| 9,101,185 | B1 | 8/2015 | Greenberg |
| 9,245,678 | B2 | 1/2016 | Fiedler |
| D749,983 | S | 2/2016 | Paik et al. |
| 9,249,814 | B2 | 2/2016 | Tsai |
| D774,413 | S | 12/2016 | Paik et al. |
| 9,555,935 | B2 | 1/2017 | Fiedler |
| D778,207 | S | 2/2017 | Paik et al. |
| D778,777 | S | 2/2017 | Paik et al. |
| 9,572,410 | B2 | 2/2017 | Fiedler |
| D782,152 | S | 3/2017 | Woodward |
| 9,635,919 | B2 | 5/2017 | Fiedler |
| 9,677,581 | B2 | 6/2017 | Tucholke et al. |
| 9,717,323 | B2 | 8/2017 | Tsai |
| 9,907,367 | B2 | 3/2018 | Paik et al. |
| 9,936,772 | B2 | 4/2018 | Paik |
| D817,830 | S | 5/2018 | Archambault |
| 9,986,791 | B2 | 6/2018 | Botkus et al. |
| D822,536 | S | 7/2018 | Wu |
| 10,098,422 | B2 | 10/2018 | Fiedler et al. |
| 10,111,499 | B2 | 10/2018 | Fiedler et al. |
| 10,143,270 | B2 | 12/2018 | Fiedler et al. |
| 10,179,548 | B2 | 1/2019 | Fiedler et al. |
| 10,202,790 | B2 | 2/2019 | Fiedler |
| 10,212,993 | B2 | 2/2019 | Fiedler et al. |
| D845,168 | S | 4/2019 | Paik et al. |
| 10,315,549 | B2 | 6/2019 | Fiedler |
| 10,328,983 | B2 | 6/2019 | Fiedler et al. |
| 10,383,409 | B2 | 8/2019 | Fiedler |
| 10,385,895 | B2 | 8/2019 | Fiedler et al. |
| 10,578,241 | B2 | 3/2020 | Fiedler |
| 10,617,179 | B2 | 4/2020 | Fiedler et al. |
| 10,626,636 | B2 | 4/2020 | Fiedler |
| 10,703,429 | B2 | 7/2020 | Fiedler et al. |
| 10,758,019 | B2 | 9/2020 | Paik et al. |
| 10,791,804 | B2 | 10/2020 | Chu et al. |
| 2010/0283269 | A1 | 11/2010 | Fiedler |
| 2010/0308605 | A1 | 12/2010 | Fiedler |
| 2010/0325844 | A1 | 12/2010 | Fiedler |
| 2011/0001025 | A1 | 1/2011 | Fiedler |
| 2011/0030174 | A1 | 2/2011 | Fiedler |
| 2011/0131770 | A1 | 6/2011 | Fiedler |
| 2011/0167595 | A1 | 7/2011 | Fiedler |
| 2011/0296653 | A1 | 12/2011 | Fiedler |
| 2011/0298227 | A1 | 12/2011 | Fiedler |
| 2012/0124786 | A1 | 5/2012 | Fiedler |
| 2012/0216373 | A1 | 8/2012 | Fiedler |
| 2012/0227220 | A1 | 9/2012 | Fiedler |
| 2012/0248793 | A1 | 10/2012 | Fiedler |
| 2012/0291227 | A1 | 11/2012 | Fiedler |
| 2013/0011179 | A1 | 1/2013 | Fiedler |
| 2014/0317890 | A1 | 10/2014 | Koons et al. |
| 2014/0339232 | A1 | 11/2014 | Fiedler |
| 2015/0327631 | A1* | 11/2015 | Kaneko ..... A44B 11/266 24/665 |
| 2016/0198813 | A1 | 7/2016 | Fiedler et al. |
| 2017/0015229 | A1 | 1/2017 | Fiedler |
| 2018/0132670 | A1 | 5/2018 | Beckerman et al. |
| 2019/0174875 | A1 | 6/2019 | Cheng |

FOREIGN PATENT DOCUMENTS

| | | | |
|---|---|---|---|
| EP | 3165118 | B1 | 6/2018 |
| EP | 3183986 | B1 | 7/2018 |
| EP | 3616552 | A1 | 3/2020 |
| JP | H0947306 | A | 2/1997 |
| JP | 3215771 | U | 3/2018 |
| JP | 2018164494 | A | 10/2018 |
| WO | 2020173410 | A1 | 9/2020 |

* cited by examiner

100

BUCKLE ASSEMBLY

BACKGROUND OF THE INVENTION

1. Field of the Invention

The present invention relates to a child product, and more specifically, to a buckle assembly.

2. Description of the Prior Art

With development of economy and advancement of technology, there are more and more consumer products available in the market to bring convenience in people's life. Child carriers are one of the consumer products.

It is well-known that straps are indispensable for the child carriers, and buckle assemblies are commonly used on the straps for fastening and unfastening the straps.

Currently, a conventional buckle assembly includes a male buckle, a female buckle for engaging with the male buckle and a release button. The male buckle the female buckle can be disengaged from each other by the release button. The release button is usually located at a front surface or a rear surface of one of the male buckle and the female buckle for providing an easy access for a user to operate the release button. However, since the release button is located at such a conspicuous place, it is easy for a child sitting in a child carrier to recognize existence of the release button, which leads to a potential hazard caused by an unintentional release operation of the buckle assembly due to the child's subconscious touching. Meanwhile, when the release button of the conventional buckle assembly is operated, it is required to apply a great force on the release button, which causes a difficulty in the release operation.

Furthermore, the configuration of the release button located at the front surface or the rear surface of the one of the male buckle and the female buckle increases a possibility of being hit by other objects, which also leads to the potential hazard caused by the unintentional release operation of the buckle assembly. Although there is a buckle assembly having an inconspicuous release button, such buckle assembly has a complicated structure and a difficult release operation.

Therefore, there is a need to provide an improved buckle assembly to solve the aforementioned problems.

SUMMARY OF THE INVENTION

It is an objective of the present invention to provide a buckle assembly with an inconspicuous operating component and easy operation.

In order to achieve the aforementioned objective, the present invention discloses a buckle assembly. The buckle assembly includes a first buckle component, a second buckle component and an operating component. The first buckle component includes a locked portion. The second buckle component includes a locking portion configured to cooperate with the locked portion. The locking portion engages with the locked portion along a lateral direction of the buckle assembly when the second buckle component is mated with the first buckle component along a mating direction. The operating component is partially embedded in the second buckle component and partially exposed out of the second buckle component. The operating component is configured to cooperate with the locking portion and slidable relative to the second buckle component. The operating component drives the locking portion to move away from the locked portion for disengaging the locking portion from the locked portion during a sliding movement of the operating component relative to the second buckle component.

According to an embodiment of the present invention, the locked portion is located at a front surface of the first buckle component.

According to an embodiment of the present invention, the locking portion is a resilient structure, and the operating component resiliently deforms the locking portion for disengaging the locking portion from the locked portion during the sliding movement of the operating component relative to the second buckle component.

According to an embodiment of the present invention, the locking portion includes a resilient arm and a locking head connected to the resilient arm. The resilient arm is configured to cooperate with the operating component. The locking head is configured to engage with the locked portion. The resilient arm is biased to engage the locking head with the locked portion, and the operating component resiliently deforms the resilient arm for disengaging the locking head from the locked portion during the sliding movement of the operating component relative to the second buckle component.

According to an embodiment of the present invention, the operating component is slidable relative to the second buckle component along the lateral direction. An abutting portion protrudes from the operating component along the lateral direction. A cooperating portion is formed on a free end of the resilient arm and for cooperating with the abutting portion, and the operating component abuts against the cooperating portion by the abutting portion to resiliently deform the resilient arm for disengaging the locking head from the locked portion during the sliding movement of the operating component relative to the second buckle component.

According to an embodiment of the present invention, the cooperating portion is aligned with the abutting portion along the lateral direction.

According to an embodiment of the present invention, the locking head protrudes from an inner wall of the resilient arm along the lateral direction, and the cooperating portion is adjacent to the locking head.

According to an embodiment of the present invention, the locking head and the cooperating portion are sequentially arranged along a direction from a fixing end of the resilient arm toward the free end of the resilient arm.

According to an embodiment of the present invention, the locking portion is detachably connected to the second buckle component.

According to an embodiment of the present invention, the locking portion further includes an engaging bracket fixedly connected to a fixing end of the resilient arm. An engaged structure is formed on the second buckle component and for detachably engaging with the engaging bracket, and the engaging bracket is detachably embedded into the engaged structure.

According to an embodiment of the present invention, the engaged structure includes at least two engaged rods spaced apart from each other. The engaging bracket is embedded between the at least two engaged rods. Each of the at least two engaged rods includes an upper restraining part and a lower restraining part. The upper restraining part and the lower restraining part are configured to restrain movement of the engaging bracket, and the engaging bracket is located between the upper restraining part and the lower restraining part when the engaging bracket is detachably embedded into the engaged structure.

According to an embodiment of the present invention, the engaging bracket includes a step-shaped structure for engaging with the lower restraining part when the engaging bracket is detachably embedded into the engaged structure.

According to an embodiment of the present invention, an avoiding space is formed between the at least two engaged rods and for allowing the resilient arm to move.

According to an embodiment of the present invention, the locked portion includes an abutting structure and a locked structure. The abutting structure abuts against the locking head to resiliently deform the resilient arm during a mating process of the first buckle component and the second buckle component. The locked structure is configured to engage with the locking head, and the operating component resiliently deforms the resilient arm for disengaging the locking head from the locked structure during the sliding movement of the operating component relative to the second buckle component.

According to an embodiment of the present invention, an end portion of the abutting structure includes a first inclined part inclined relative to the mating direction. The locking head includes a second inclined part for cooperating with the first inclined part, and the abutting structure resiliently deforms the resilient arm by abutment of the first inclined part and the second inclined part to pass across the locking head for engaging the locked structure with the locking head during the mating process of the first buckle component and the second buckle component.

According to an embodiment of the present invention, the locked structure is an enclosed recess, and the locking head is configured to engage with the enclosed recess.

According to an embodiment of the present invention, the locking portion includes a first locking portion and a second locking portion. The first locking portion and the second locking portion are located at two opposite sides of the locked portion and clamp the locked portion along the lateral direction. The operating component includes a first operating component and a second operating component. The first operating component and the first locking portion are located at a same side. The second operating component and the second locking portion are located at another same side. The first operating component is configured to cooperate with the second locking portion. The second operating component is configured to cooperate with the first locking portion, and the first operating component and the second operating component respectively deform the second locking portion and the first locking portion for disengaging the first locking portion and the second locking portion from the locked portion during the sliding movement of the operating component relative to the second buckle component.

According to an embodiment of the present invention, the first locking portion includes a first resilient arm and a first locking head connected to the first resilient arm. The first resilient arm is configured to cooperate with the second operating component. The first locking head is configured to engage with the locked portion. The first resilient arm is biased to engage the first locking head with the locked portion. The second operating component is configured to resiliently deform the first resilient arm for disengaging the first locking head from the locked portion. The second locking portion includes a second resilient arm and a second locking head connected to the second resilient arm. The second resilient arm is configured to cooperate with the first operating component. The second locking head is configured to engage with the locked portion. The second resilient arm is biased to engage the second locking head with the locked portion, and the first operating component is configured to resiliently deform the second resilient arm for disengaging the second locking head from the locked portion.

According to an embodiment of the present invention, the first operating component is slidable relative to the second buckle component along the lateral direction. A first abutting portion protrudes from the first operating component along the lateral direction. A second cooperating portion is formed on a free end of the second resilient arm and for cooperating with the first abutting portion. The first operating component abuts against the second cooperating portion by the first abutting portion to resiliently deform the second resilient arm for disengaging the second locking head from the locked portion during a sliding movement of the first operating component relative to the second buckle component. The second operating component is slidable relative to the second buckle component along the lateral direction. A second abutting portion protrudes from the second operating component along the lateral direction. A first cooperating portion is formed on a free end of the first resilient arm and for cooperating with the second abutting portion, and the second operating component abuts against the first cooperating portion by the second abutting portion to resiliently deform the first resilient arm for disengaging the first locking head from the locked portion during a sliding movement of the second operating component relative to the second buckle component.

According to an embodiment of the present invention, the first cooperating portion is aligned with the second abutting portion along the lateral direction, and the second cooperating portion is aligned with the first abutting portion along the lateral direction.

According to an embodiment of the present invention, the first locking head protrudes from an inner wall of the first resilient arm along the lateral direction. The first cooperating portion is adjacent to the first locking head. The second locking head protrudes from an inner wall of the second resilient arm along the lateral direction, and the second cooperating portion is adjacent to the first locking head.

According to an embodiment of the present invention, the first locking head and the first cooperating portion are sequentially arranged along a direction from a fixing end of the first resilient arm to the free end of the first resilient arm, and the second locking head and the second cooperating portion are sequentially arranged along a direction from a fixing end of the second resilient arm to the free end of the second resilient arm.

According to an embodiment of the present invention, the first cooperating portion and the second cooperating portion are located at different levels along an up-down direction of the buckle assembly, and the first abutting portion and the second abutting portion are located at different levels along the up-down direction.

According to an embodiment of the present invention, the first cooperating portion is misaligned with the second cooperating portion along the lateral direction, and the first abutting portion is misaligned with the second abutting portion along the lateral direction.

According to an embodiment of the present invention, the buckle assembly further includes a first magnetic structure and a second magnetic structure. The first magnetic structure is disposed on the first buckle component. The second magnetic structure is disposed on the second buckle component, and the first magnetic structure magnetically attracts or repels the second magnetic structure during the mating process of the first buckle component and the second buckle component.

According to an embodiment of the present invention, a first embedding chamber is formed on the first buckle component. A second embedding chamber is formed on the second buckle component. The first magnetic structure is embedded into the first embedding chamber, and the second magnetic structure is embedded into the second embedding chamber.

According to an embodiment of the present invention, the first embedding chamber is aligned with the second embedding chamber along the mating direction.

According to an embodiment of the present invention, a mating hole is formed on the second buckle component and for allowing the locked portion to pass therethrough.

According to an embodiment of the present invention, the buckle assembly further includes a resilient component disposed between the operating component and the second buckle component and for biasing the operating component to slide away from the locking portion.

According to an embodiment of the present invention, a C-shaped structure is formed on the second buckle component and for accommodating the resilient component.

According to an embodiment of the present invention, a restraining protrusion protrudes from the operating component. The second buckle component includes a restraining block for cooperating with the restraining protrusion, and the second buckle component blocks the operating component by abutment of the restraining block and the restraining protrusion for preventing disengagement of the operating component and the second buckle component.

According to an embodiment of the present invention, one of the first buckle component and the second buckle component is a male buckle, and another of the first buckle component and the second buckle component is a female buckle.

According to an embodiment of the present invention, the locking portion includes a rotating arm, a locking head and a recovering component. The rotating arm is pivotally connected to the second buckle component. The locking head is connected to the rotating arm and for engaging with the locked portion. The operating component is configured to drive the rotating arm to rotate for disengaging the locking head from the locked portion, and the recovering component is disposed between the rotating arm and the second buckle component and for biasing the rotating arm to rotate to engage the locking head with the locked portion.

According to an embodiment of the present invention, the operating component is slidable relative to the second buckle component along the lateral direction. An abutting portion protrudes from the operating component along the lateral direction. A cooperating portion is formed on the rotating arm and for cooperating with the abutting portion. The cooperating portion is aligned with the abutting portion along the lateral direction, and the operating component drives the rotating arm to rotate by abutment of the abutting portion and the cooperating portion for disengaging the locking head from the locked portion during the sliding movement of the operating component relative to the second buckle component.

According to an embodiment of the present invention, the operating component is slidable relative to the second buckle component along an extending direction perpendicular to the lateral direction and the mating direction. An abutting portion protrudes from the operating component along the extending direction. A cooperating portion is formed on the rotating arm and for cooperating with the abutting portion. The cooperating portion is aligned with the abutting portion along the mating direction, and the operating component drives the rotating arm to rotate by abutment of the abutting portion and the cooperating portion for disengaging the locking head from the locked portion during the sliding movement of the operating component.

According to an embodiment of the present invention, the operating component is slidable relative to the second buckle component along the mating direction. An abutting portion protrudes from the operating component along the mating direction. A cooperating portion is formed on the rotating arm and for cooperating with the abutting portion. The cooperating portion is aligned with the abutting portion along the mating direction, and the operating component drives the rotating arm to rotate by abutment of the abutting portion and the cooperating portion for disengaging the locking head from the locked portion during the sliding movement of the operating component.

According to an embodiment of the present invention, the locking portion includes a first locking portion and a second locking portion. The first locking portion and the second locking portion are located at two opposite sides of the locked portion and clamp the locked portion along the lateral direction. The first locking portion includes a first rotating arm, a first locking head and a first recovering component. The first rotating arm is pivotally connected to the second buckle component. The first locking head is connected to the first rotating arm and for engaging with the locked portion. The first locking head protrudes from an inner wall of the first rotating arm along the lateral direction. The first recovering component is disposed between the first rotating arm and the second buckle component and for biasing the first rotating arm to rotate to engage the first locking head with the locked portion. The second locking portion includes a second rotating arm, a second locking head and a second recovering component. The second rotating arm is pivotally connected to the second buckle component. The second locking head is connected to the second rotating arm and for engaging with the locked portion. The second locking head protrudes from an inner wall of the second rotating arm along the lateral direction, and the second recovering component is disposed between the second rotating arm and the second buckle component and for biasing the second rotating arm to rotate to engage the second locking head with the locked portion.

According to an embodiment of the present invention, the operating component includes a first operating component and a second operating component. The first operating component and the first locking portion are located at a same side. The second operating component and the second locking portion are located at another same side. The first operating component and the second operating component are slidable relative to the second buckle component along the lateral direction. A first abutting portion protrudes from the first operating component along the lateral direction. A second cooperating portion is formed on the second rotating arm and for cooperating with the first abutting portion. The second cooperating portion is aligned with the first abutting portion along the lateral direction. The first operating component drives the second rotating arm to rotate by abutment of the first abutting portion and the second cooperating portion for disengaging the second locking head from the locked portion during a sliding movement of the first operating component. A second abutting portion protrudes from the second operating component along the lateral direction. A first cooperating portion is formed on the first rotating arm and for cooperating with the second abutting portion. The first cooperating portion is aligned with the second abutting portion along the lateral direction. The second operating component drives the first rotating arm to rotate by abutment of the second abutting portion and the first cooperating portion for disengaging the first locking head from the locked portion during a sliding movement of the second operating component. The first cooperating portion and the second cooperating portion are located at different levels along an up-down direction of the buckle assembly. The first cooperating portion is misaligned with the second cooperating portion along the lateral direction. The first abutting portion and the second abutting portion are located at different levels along the up-down direction of the buckle assembly, and the first abutting portion is misaligned with the second abutting portion along the lateral direction.

According to an embodiment of the present invention, the operating component is slidable relative to the second buckle component along an extending direction perpendicular to the lateral direction and the mating direction. A first abutting portion and a second abutting portion protrude from the operating component along the extending direction. A second cooperating portion is formed on the second rotating arm and for cooperating with the first abutting portion. The second cooperating portion is aligned with the first abutting portion along the extending direction. A first cooperating portion is formed on the first rotating arm and for cooperating with the second abutting portion. The first cooperating portion is aligned with the second abutting portion along the extending direction, and the operating component drives the first rotating arm and the second rotating arm to rotate by abutment of the second abutting portion and the first cooperating portion and abutment of the first abutting portion and the second cooperating portion for disengaging the first locking head and the second locking head from the locked portion during the sliding movement of the operating component.

According to an embodiment of the present invention, the operating component is slidable relative to the second buckle component along the mating direction. A first abutting portion and a second abutting portion protrude from the operating component along the mating direction. A second cooperating portion is formed on the second rotating arm and for cooperating with the first abutting portion. The second cooperating portion is aligned with the first abutting portion along the mating direction. A first cooperating portion is formed on the first rotating arm and for cooperating with the second abutting portion. The first cooperating portion is aligned with the second abutting portion along the mating direction, and the operating component drives the first rotating arm and the second rotating arm to rotate by abutment of the second abutting portion and the first cooperating portion and abutment of the first abutting portion and the second cooperating portion for disengaging the first locking head and the second locking head from the locked portion during the sliding movement of the operating component.

In summary, in the present invention, the operating component is disposed on the second buckle component including the locking portion which cooperates with the locked portion of the first buckle component. The operating component drives the locking portion to disengage the locking portion from the locked portion when the operating component is operated. Therefore, the present invention has advantages of simple structure and labor-saving and easy operation.

These and other objectives of the present invention will no doubt become obvious to those of ordinary skill in the art after reading the following detailed description of the preferred embodiment that is illustrated in the various figures and drawings.

DETAILED DESCRIPTION

In order to illustrate technical specifications and structural features as well as achieved purposes and effects of the present invention, relevant embodiments and figures are described as follows.

Figure 1:
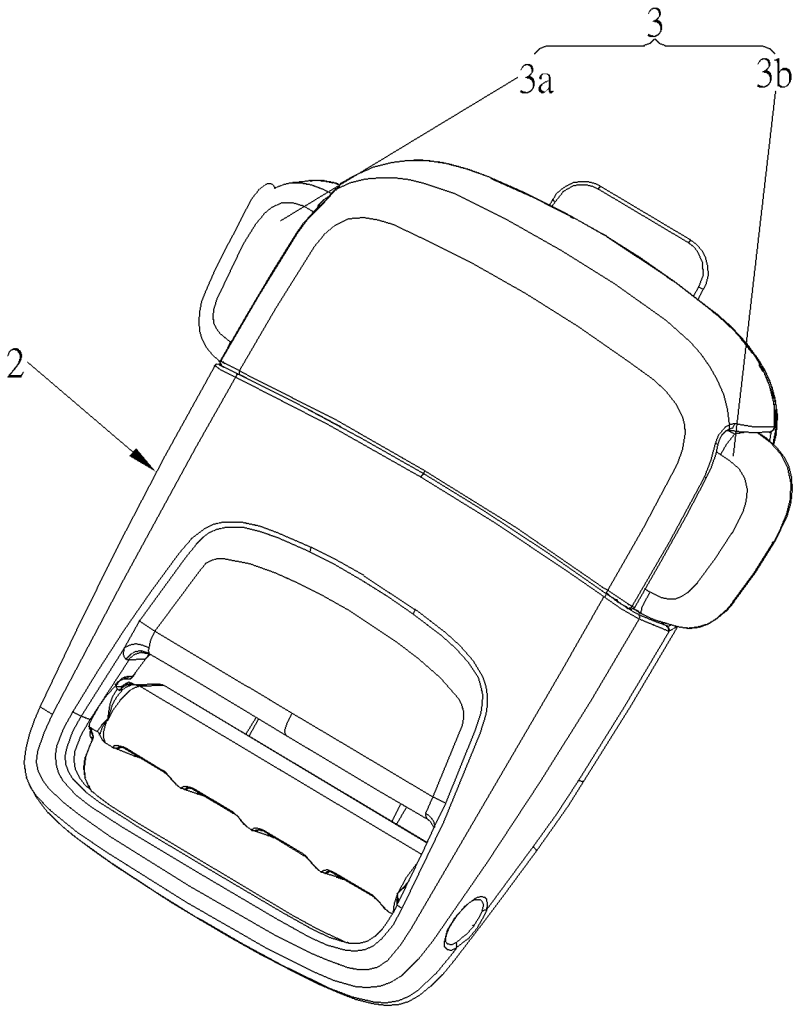
FIG. 1 is a schematic diagram of a buckle assembly according to a first embodiment of the present invention.
Figure 2:
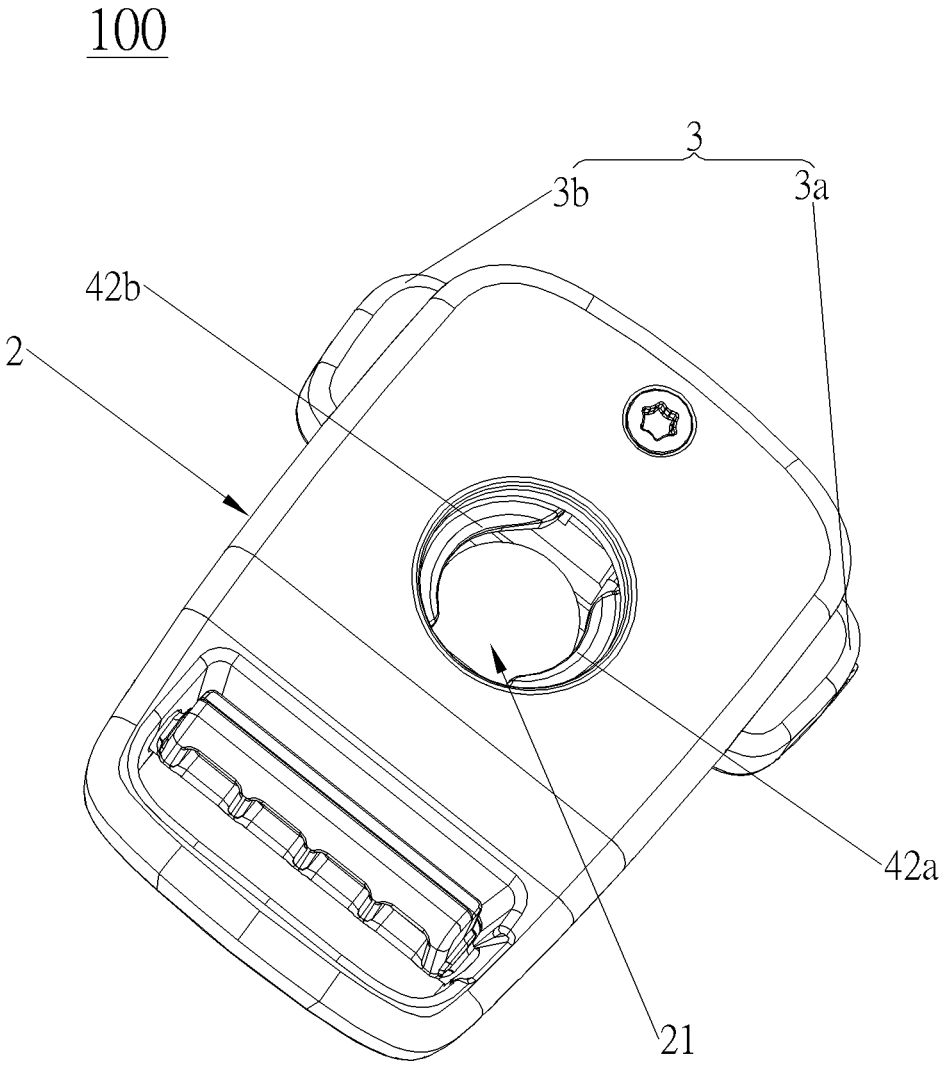
FIG. 2 is a diagram of a second buckle component of the buckle assembly according to the first embodiment of the present invention.
Figure 3:
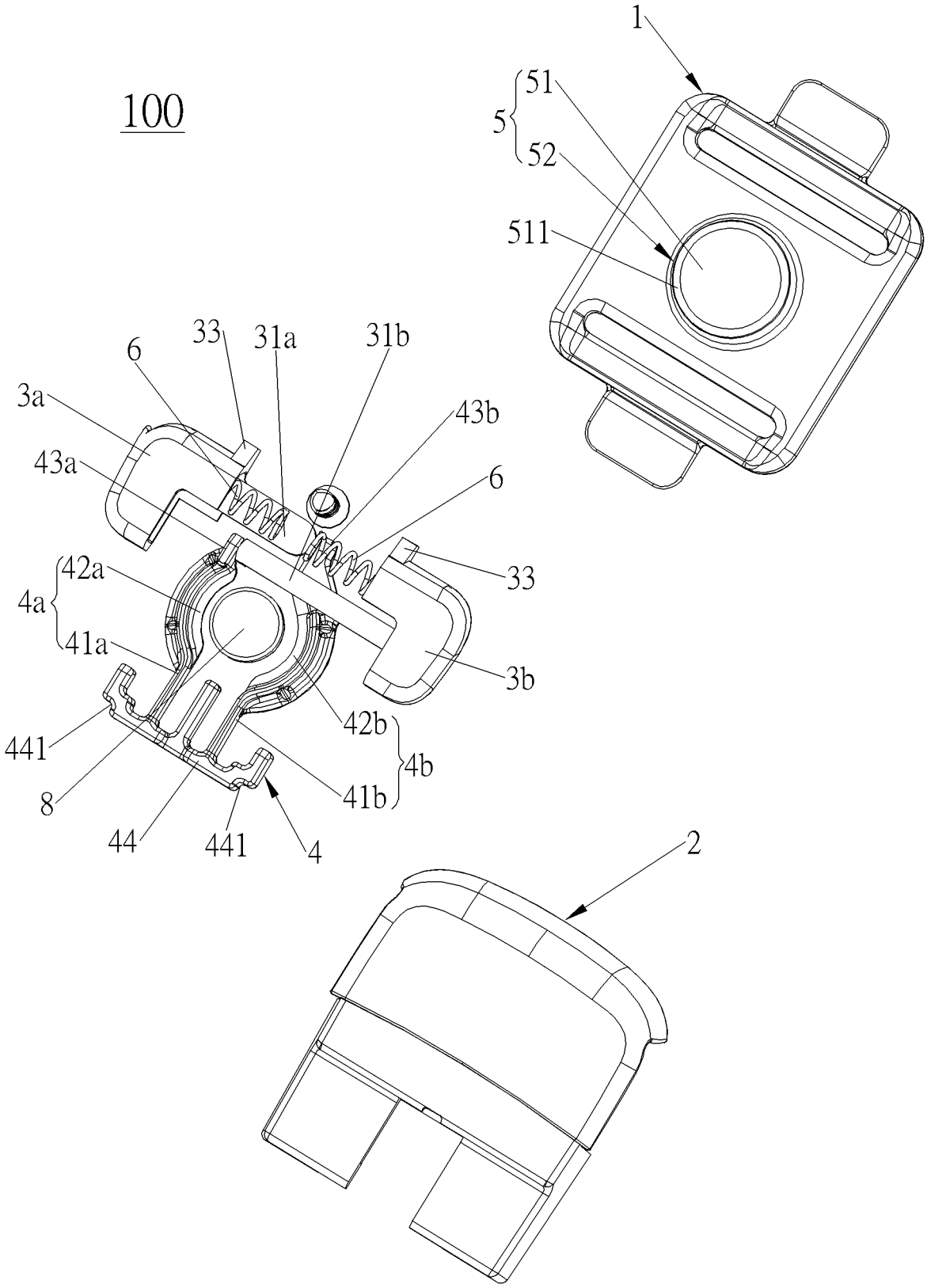
FIG. 3 and FIG. 4 are exploded diagrams of the buckle assembly according to the first embodiment of the present invention.
Figure 4:
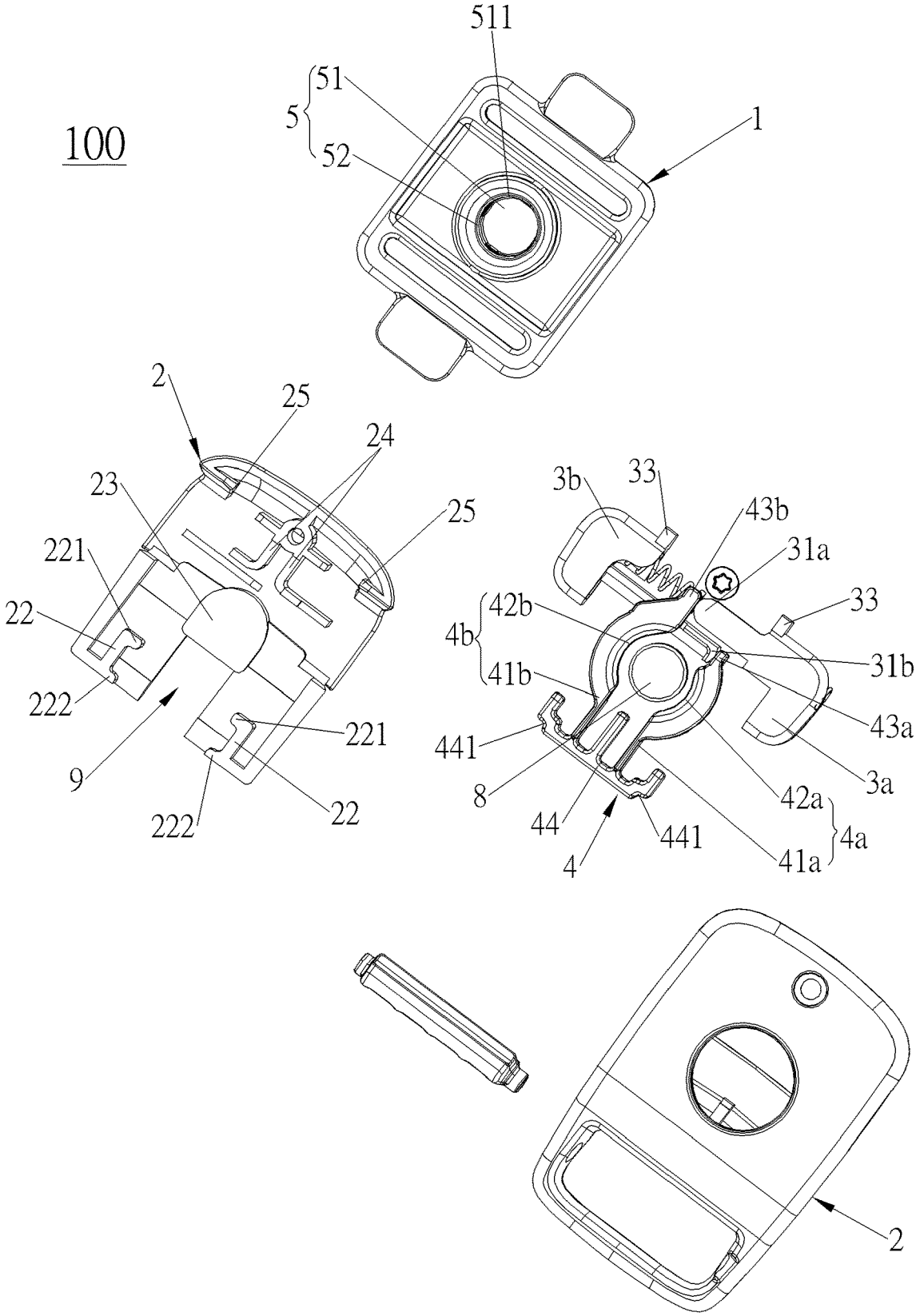
Figure 5:
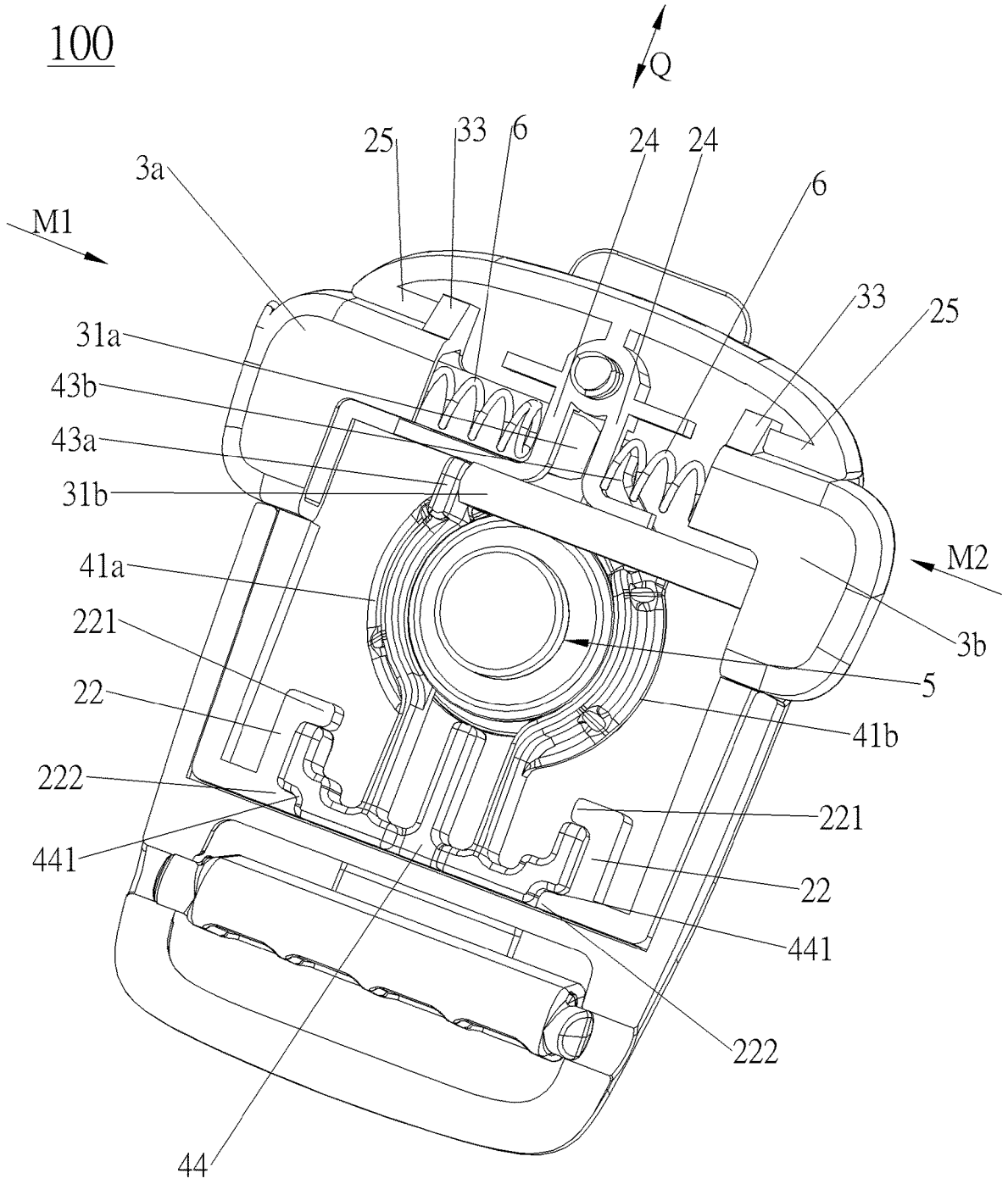
FIG. 5 is a partial diagram of the buckle assembly according to the first embodiment of the present invention.
Figure 6:
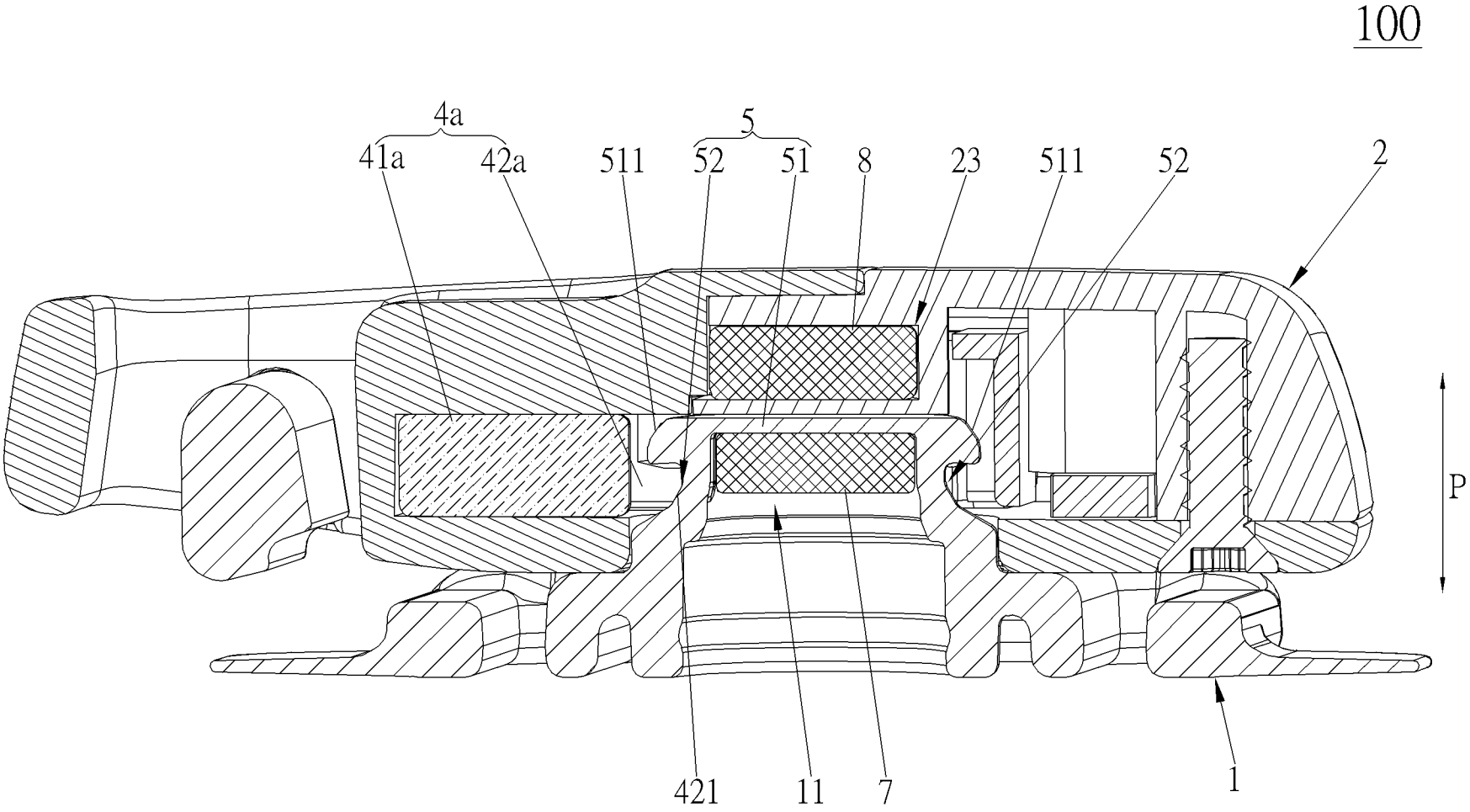
FIG. 6 is a sectional diagram of the buckle assembly according to the first embodiment of the present invention.

Please refer to FIG. 1 to FIG. 6. FIG. 1 is a schematic diagram of a buckle assembly 100 according to a first embodiment of the present invention. FIG. 2 is a diagram of a second buckle component 2 of the buckle assembly 100 according to the first embodiment of the present invention. FIG. 3 and FIG. 4 are exploded diagrams of the buckle assembly 100 according to the first embodiment of the present invention. FIG. 5 is a partial diagram of the buckle assembly 100 according to the first embodiment of the present invention. FIG. 6 is a sectional diagram of the buckle assembly 100 according to the first embodiment of the present invention. As shown in FIG. 1 to FIG. 6, the buckle assembly 100 includes a first buckle component 1, the second buckle component 2, an operating component 3 and two resilient components 6. The second buckle component 2 includes a locking portion 4. The first buckle component 1 includes a locked portion 5 configured to cooperate with the locking portion 5. The locking portion 4 engages with the locked portion 5 along a lateral direction when the first buckle component 1 is mated with the second buckle component 2 along a mating direction, which can be an arrow direction P shown in FIG. 6. In this embodiment, the first buckle component 1 can be a male buckle, and the second buckle component 2 can be a female buckle. However, it is not limited to this embodiment. In another embodiment, the first buckle component can be a female buckle, and the second buckle component can be a male buckle.

The operating component 3 is partially embedded into the second buckle component 2 and partially exposed out of a lateral wall of the second buckle component 2. The operating component 3 is configured to cooperate with the locking portion 4 and slidable relative to the second buckle component 2 along the lateral direction. It should be noticed that, in this embodiment, the lateral direction can be an arrow direction M1 or M2 shown in FIG. 5. The operating component 3 drives the locking portion 4 to move away from the locked portion 5 for disengaging the locking portion 4 from the locked portion 5 during a sliding movement of the operating component 3 relative to the second buckle component 2 along the lateral direction. A sliding direction of the operating component 3 can be the same as or opposite a moving direction of the locking portion 4, so that a force acting on the operating component 3 and provided by a user can be completely transmitted to the locking portion 4 along the sliding direction to disengage the locking portion 4 from the locked portion 5, which prevents dispersion of the force in different directions to ensure a labor-saving and easy release operation of the buckle assembly 100.

The locked portion 5 is located at a front surface of the first buckle component 1. A mating hole 21 is formed on the second buckle component 2 for allowing the locked portion 5 to pass therethrough, and the mating direction, which can be the arrow direction P shown in FIG. 6, is intersected with the sliding direction of the operating component 3, which can be the arrow direction M1 or M2 shown in FIG. 5. Such configuration can reduce a thickness of the buckle assembly 100 along the mating direction and allow a reasonable use of an internal space of the buckle assembly 100.

Specifically, as shown in FIG. 3 to FIG. 6, the locking portion 4 is a resilient structure. The operating component 3 resiliently deforms the locking portion 4 along the lateral direction for disengaging the locking portion 4 from the locked portion 5 during the sliding movement of the operating component 3 relative to the second buckle component 2. More specifically, the locking portion 4 includes a first locking portion 4*a* and a second locking portion 4*b*. The first locking portion 4*a* and the second locking portion 4*b* are located at two opposite sides of the locked portion 5 and clamp the locked portion 5 along the lateral direction. The operating component 3 includes a first operating component 3*a* and a second operating component 3*b*. The first operating component 3*a* and the first locking portion 4*a* are located at a same side. The second operating component 3*b* and the second locking portion 4*b* are located at another same side. The first operating component 3*a* is configured to cooperate with the second locking portion 4*b*. The second operating component 3*b* is configured to cooperate with the first locking portion 4*a*. The first operating component 3*a* and the second operating component 3*b* respectively deform the second locking portion 4*b* and the first locking portion 4*a* away from the locked portion 5 for disengaging the first locking portion 4*a* and the second locking portion 4*b* from the locked portion 5 during the sliding movement of the operating component 3 relative to the second buckle component 2. By cooperation of the first operating component 3*a* and the second locking portion 4*b* and cooperation of the second operating component 3*b* and the first locking portion 4*a*, an engaging operation and the release operation of the buckle assembly 100 are more reliable. However, the structures of the operating component and the locking portion are not limited to this embodiment. For example, in another embodiment, the operating component can include one, three or four operating components, and the locking portion can include one, three or four locking portions accordingly.

As shown in FIG. 3 to FIG. 6, the first locking portion 4*a* includes a first resilient arm 41*a* and a first locking head 42*a* connected to the first resilient arm 41*a*. The first resilient arm 41*a* is configured to cooperate with the second operating component 3*b*. The first locking head 42*a* is configured to engage with the locked portion 5. The first resilient arm 41*a* is biased to engage the first locking head 42*a* with the locked portion 5. The second operating component 3*b* resiliently deforms the first resilient arm 41*a* away from the locked portion 5 for disengaging the first locking head 42*a* from the locked portion 5 during a sliding movement of the second operating component 3*b* relative to the second buckle component 2. The second locking portion 4*b* includes a second resilient arm 41*b* and a second locking head 42*b* connected to the second resilient arm 41*b*. The second resilient arm 41*b* is configured to cooperate with the first operating component 3*a*. The second locking head 42*b* is configured to engage with the locked portion 5. The second resilient arm 41*b* is biased to engage the second locking head 42*b* with the locked portion 5. The first operating component 3*a* resiliently deforms the second resilient arm 41*b* away from the locked portion 5 for disengaging the second locking head 42*b* from the locked portion 5 during a sliding movement of the first operating component 3*a* relative to the second buckle component 2.

Preferably, in this embodiment, the second operating component 3*b* can be configured to push the first resilient arm 41*a* to resiliently deform the first resilient arm 41*a* away from the locked portion 5, and the first operating component 3*a* can be configured to push the second resilient arm 41*b* to resiliently deform the second resilient arm 41*b* away from the locked portion 5, i.e., the force acting on the operating component 3 and provided by the user can be a pushing force. However, it is not limited to this embodiment. For example, in another embodiment, the first operating component can be configured to pull the first resilient arm to resiliently deform the first resilient arm away from the locked portion, and the second operating component can be configured to pull the second resilient arm to resiliently deform the second resilient arm away from the locked portion, i.e., the force acting on the operating component and provided by the user can be a pulling force. Therefore, it is understandable that the user can push or pull the operating component to resiliently deform the first resilient arm and the second resilient arm away from the locked portion.

As shown in FIG. 3 to FIG. 6, a first abutting portion 31*a* protrudes from the first operating component 3*a* along the lateral direction. A second cooperating portion 43*b* is formed on a free end of the second resilient arm 41*b* and for cooperating with the first abutting portion 31*a*. The first operating component 3*a* resiliently deforms the second resilient arm 41*b* away from the locked portion 5 by abutment of the first abutting portion 31*a* and the second cooperating portion 43*b* for disengaging the second locking head 42*b* from the locked portion 5. A second abutting portion 31*b* protrudes from the second operating component 3*b* along the lateral direction. A first cooperating portion 43*a* is formed on a free end of the first resilient arm 41*a* and for cooperating with the second abutting portion 31*b*. The second operating component 3*b* resiliently deforms the first resilient arm 41*a* away from the locked portion 5 by abutment of the second abutting portion 31*b* and the first cooperating portion 43*a* for disengaging the first locking head 42*a* from the locked portion 5. Preferably, the first cooperating portion 43*a* can be aligned with the second abutting portion 31*b* along the lateral direction, and the second cooperating portion 43*b* can be aligned with the first abutting portion 31*a* along the lateral direction, which makes abutment of the operating component 3 more precise and the release operation of the buckle assembly 100 more labor saving.

As shown in FIG. 3 to FIG. 6, the first locking head 42*a* protrudes from an inner wall of the first resilient arm 41*a* along the lateral direction. The first cooperating portion 43*a* is adjacent to the first locking head 42*a*. The second locking head 42*b* protrudes from an inner wall of the second resilient arm 41*b* along the lateral direction. The second cooperating portion 43*b* is adjacent to the second locking head 42*b*. Therefore, when the first abutting portion 31*a* and the second abutting portion 31*b* respectively push the second cooperating portion 43*b* and the first cooperating portion 43*a*, the first resilient arm 41*a* and the second resilient arm 41*b* are resiliently deformed away from the locked portion 5 for disengaging the first locking head 42*a* and the second locking head 42*b* from the locked portion 5 rapidly. Preferably, the first locking head 42*a* and the first cooperating portion 43*a* can be sequentially arranged along a direction from a fixing end of the first resilient arm 41*a* toward the free end of the first resilient arm 41*a*, and the second locking head 42*b* and the second cooperating portion 43*b* can be sequentially arranged along a direction from a fixing end of the second resilient arm 41*b* toward the free end of the second resilient arm 41*b*. The first cooperating portion 43*a* and the second cooperating portion 43*b* can be respectively located at the free end of the first resilient arm 41*a* and the free end of the second resilient arm 41*b*, so that the force acting on the operating component 3 and provided by the user for resiliently deforming the first resilient arm 41*a* and the second resilient arm 41*b* can be small.

Specifically, the first cooperating portion 43*a* and the second cooperating portion 43*b* can be located at different levels along an up-down direction, which can be the arrow direction P shown in FIG. 6, and the first abutting portion 31*a* and the second abutting portion 31*b* can be located at different levels along the up-down direction, so that abutment of the first abutting portion 31*a* and the second cooperating portion 43*b* and abutment of the second abutting portion 31*b* and the first cooperating portion 43*a* occur at different levels, which prevents any structural interface during the sliding movements of the first operating component 3*a* and the second operating component 3*b* along the lateral direction and ensures reliability of the release operation of the buckle assembly 100. In this embodiment, heights of the second abutting portion 31*b* and the first cooperating portion 43*a* can be higher than heights of the first abutting portion 31*a* and the second cooperating portion 43*a*. However, it is not limited to this embodiment.

Preferably, the first cooperating portion 43*a* can be misaligned with the second cooperating portion 43*b* along the lateral direction, and the first abutting portion 31*a* can be misaligned with the second abutting portion 31*b* along the lateral direction, so that it can reduce an occupied space along the up-down direction and facilitate arrangement of the internal space of the buckle assembly 100. In this embodiment, the first abutting portion 31*a* and the second cooperating portion 43*b* can be located ahead the second abutting portion 31*b* and the first cooperating portion 43*a* along an extending direction, which can be an arrow direction Q shown in FIG. 6 and perpendicular to the lateral direction and the mating direction. However, it is not limited to this embodiment.

It is understandable that, in another embodiment, when there is only one locking portion located at one side of the locked portion and for engaging with the locked portion, there can be only one operating component located at another side of the locked portion opposite to the locking portion to resiliently push the locking portion away from the locked portion for disengaging the locking portion from the locked portion. In other words, the operating component and the locking portion can be located at two opposite sides of the locked portion to push the locking portion by the operating component for disengaging the locking portion from the locked portion. Alternatively, in another embodiment, the operating component and the locking portion can be located at a same side of the locked portion for pulling the locking portion by the operating component for disengaging the locking portion from the locked portion.

As shown in FIG. 3 to FIG. 6, the locked portion 5 includes an abutting structure 51 and a locked structure 52 configured to engage with the two locking heads, i.e., the first locking head 42*a* and the second locking head 42*b*. The abutting structure 51 abuts against the two locking heads to resiliently deform the two resilient arms, i.e., the first resilient arm 41*a* and the second resilient arm 41*b*, to pass across the two locking heads for allowing the locked structure 52 to engage with the two locking heads during a mating process of the first buckle component 1 and the second buckle component 2. The operating component 3 resiliently deforms the two resilient arms for disengaging the two locking heads from the locked structure 52 during the sliding movement of the operating component 3 relative to the second buckle component 2. Preferably, an end portion of the abutting structure 51 can include a first inclined part 511 inclined relative to the mating direction. Each locking heads includes a second inclined part 421 for cooperating with the first inclined part 511. The abutting structure 51 resiliently deforms the two resilient arms by abutment of the first inclined part 511 and the second inclined parts 421 of the two locking heads to pass across the two locking heads for engaging the locked structure 52 with the two locking heads during the mating process of the first buckle component 1 and the second buckle component 2. Furthermore, the locked structure 52 can be an enclosed recess, and the two locking heads can engage with the enclosed recess. However, it is not limited thereto.

As shown in FIG. 3 to FIG. 5, each resilient component 6 is disposed between the second buckle component 2 and a corresponding one of the first operating component 3*a* and the second operating component 3*b* and for biasing the corresponding one of the first operating component 3*a* and the second operating component 3*b* to slide away from the locking portion 4, so that the first operating component 3*a* and the second operating component 3*b* can be resiliently recovered by the two resilient components 6 when the first operating component 3*a* and the second operating component 3*b* are released. However, the number of the resilient component is not limited to this embodiment. For example, in another embodiment, when there is only one operating component, there can be only one resilient component.

Specifically, two C-shaped structures 24 are formed on the second buckle component 2 and for accommodating the two resilient components 6. The two resilient components 6 are respectively disposed between the first operating component 3*a* and the second buckle component 2 and between the second operating component 3*b* and the second buckle component 2.

As shown in FIG. 3 to FIG. 5, a restraining protrusion 33 protrudes from each of the first operating component 3*a* and the second operating component 3*b* of the operating component 3. Two restraining blocks 25 are formed on the second buckle component 2 and for cooperating with the two restraining protrusions 33. The second buckle component 2 blocks the first operating component 3*a* and the second operating component 3*b* of the operating component 3 by abutment of the two restraining blocks 25 and the two restraining protrusions 33 for preventing disengagement of the first operating component 3*a* and the second operating component 3*b* of the operating component 3 and the second buckle component 2. However, the number of the restraining block is not limited to this embodiment. For example, in another embodiment, when there is only one operating component, there can be only one restraining block.

As shown in FIG. 3 to FIG. 5, preferably, the locking portion 4 can be detachably connected to the second buckle component 2. Such configuration allows the locking portion 4 or the second buckle component 2 to be replaced easily if being damaged and simplifies a manufacturing process of the buckle assembly 100. Specifically, the locking portion 4 further includes an engaging bracket 44. An engaged structure is formed on the second buckle component 2 and for detachably engaging with the engaging bracket 44. The engaging bracket 44 is fixedly connected to the fixing end of the first resilient arm 41*a* and the fixing end of the second resilient arm 41*b* and detachably embedded into the engaged structure. More specifically, the engaged structure includes two engaged rods 22 spaced apart from each other. The engaging bracket 44 is embedded between the two engaged rods 22. Each engaged rod 22 includes an upper restraining part 221 and a lower restraining part 222. The upper restraining part 221 and the lower restraining part 222 are configured to restrain movement of the engaging bracket 44. The engaging bracket 44 is located between the upper restraining part 221 and the lower restraining part 222 when the engaging bracket 44 is detachably embedded into the engaged structure. Preferably, the engaging bracket 44 can includes two step-shaped structures 441 for engaging with the two lower restraining parts 222 when the engaging bracket 44 is detachably embedded into the engaged structure. Such configuration can prevent an unintentional disengagement of the locking portion 4 and the two lower restraining parts 222 and allow a reasonable use of an internal space of the second buckle component 2. Preferably, an avoiding space 9 can be formed between the two engaged rods 22 and for allowing the two resilient arms to move. The two resilient arms protrude out of the avoiding space 9 and are capable of being resiliently deformed to move within the avoiding space 9.

However, the numbers of the engaged rod and the step-shaped structure are not limited to this embodiment. For example, in another embodiment, the engaged structure can include one, three or more engaged rods, and the engaging bracket can include one, three or more step-shaped structures accordingly.

As shown in FIG. 3 to FIG. 6, the buckle assembly 100 further includes a first magnetic structure 7 and a second magnetic structure 8. The first magnetic structure 7 is disposed on the first buckle component 1. The second magnetic structure 8 is disposed on the second buckle component 2. The first magnetic structure 7 and the second magnetic structure 8 can magnetically attract each other during the mating process of the first buckle component 1 and the second buckle component 2, which makes mating of the first buckle component 1 and the second buckle component 2 more rapid. On the other hand, even if the locking portion 4 and the locked portion 5 are disengaged from each other, the first buckle component 1 and the second buckle component 2 can be prevented from being separated from each other due to magnetic attraction of the first magnetic structure 7 and the second magnetic structure 8, which ensure safety of the buckle assembly 100. However, it is not limited to this embodiment. For example, in another embodiment, the first magnetic structure and the second magnetic structure can be configured to magnetically repel each other during the mating process of the first buckle component and the second buckle component, which makes the release operation of the buckle assembly 100 more rapid.

Specifically, a first embedding chamber 11 is formed on the first buckle component 1. A second embedding chamber 23 is formed on the second buckle component 2. The first magnetic structure 7 is embedded into the first embedding chamber 11. The second magnetic structure 8 is embedded into the second embedding chamber 23. Preferably, the first embedding chamber 11 can be aligned with the second embedding chamber 23 along the mating direction for enhancing the magnetic attraction of the first magnetic structure 7 and the second magnetic structure 8. However, it is not limited to this embodiment. Specifically, the second embedding chamber 23 can be aligned with a space between the first locking head 42*a* and the second locking head 42*b* along the mating direction, as shown in FIG. 6, so as to achieve a reasonable use of a space of the buckle assembly 100, which makes structure of the buckle assembly 100 more compact.

As shown in FIG. 5 and FIG. 6, an operational principle of the buckle assembly 100 is provided as follows. When it is desired to release the buckle assembly 100, the first operating component 3*a* and the second operating component 3*b* can be pressed or operated to respectively resiliently deform the second resilient arm 41*b* and the first resilient arm 41*a* by the abutment of the first abutting portion 31*a* and the second cooperating portion 43*b* and the abutment of the second abutting portion 31*b* and the first cooperating portion 43*a* component 3*a* for disengaging the second locking head 42*b* and the first locking head 42*a* from the locked portion 5. When the second locking head 42*b* and the first locking head 42*a* are disengaged from the locked portion 5, i.e., the buckle assembly 100 is in a releasing state, the first buckle component 1 can be separated from the second buckle component 2 to locate the buckle assembly 100 in a separation state. Afterwards, when the first operating component 3*a* and the second operating component 3*b* are released, the two resilient components 6 drive the first operating component 3*a* and the second operating component 3*b* to recover.

When it is desired to engage the first buckle component 1 with the second buckle component 2, the locked portion 5 can be inserted into the mating hole 21 so as to abut against the first locking head 42*a* and the second locking head 42*b* by the abutting structure 51 to resiliently deform the first resilient arm 41*a* and the second resilient arm 41*b* for allowing the abutting structure 51 to pass across the first locking head 42*a* and the second locking head 42*b*. When the abutting structure 51 passes across the first locking head 42*a* and the second locking head 42*b* to align the locked structure 52 with the first locking head 42*a* and the second locking head 42*b*, the first locking head 42*a* and the second locking head 42*b* can be driven by the first resilient arm 41*a* and the second resilient arm 41*b* to engage with the locked structure 52.

Figure 7:
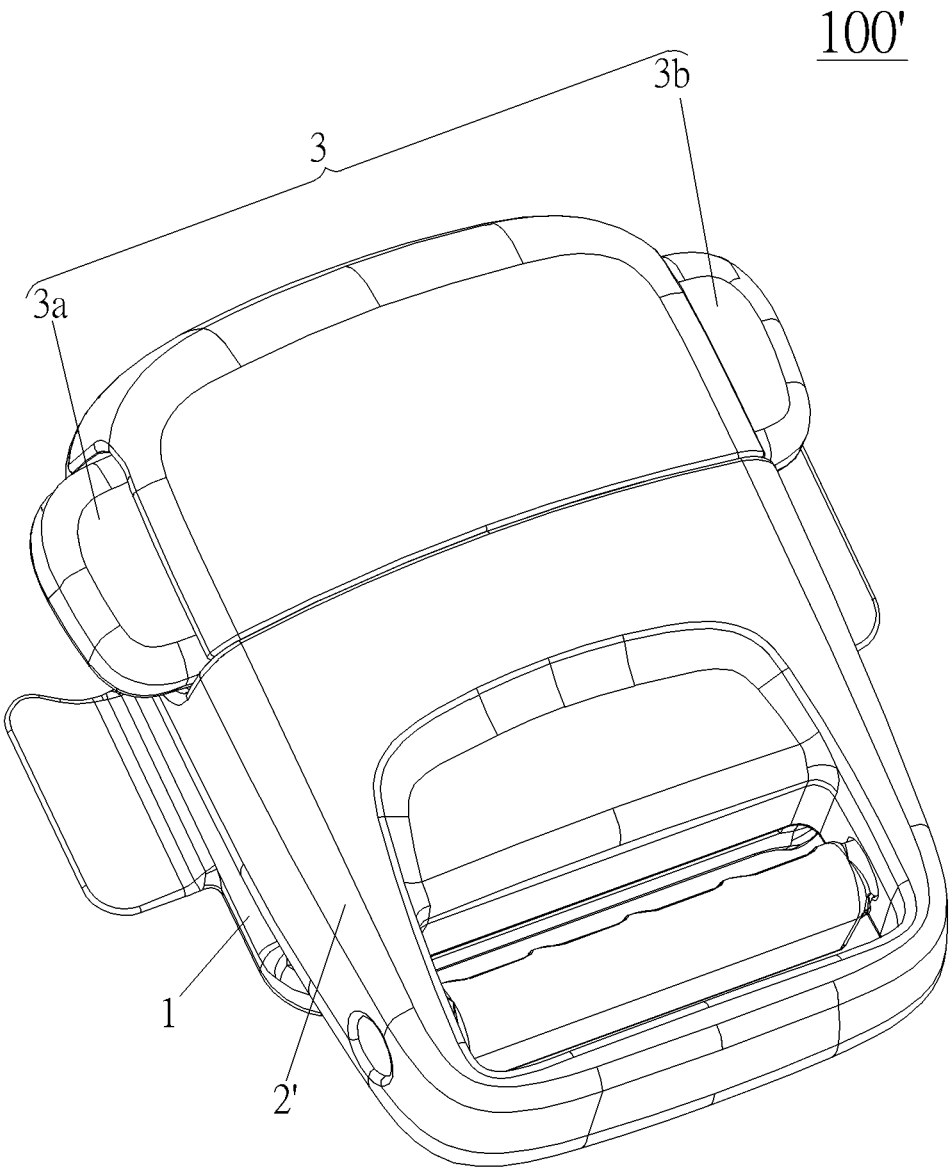
FIG. 7 is a schematic diagram of a buckle assembly according to a second embodiment of the present invention.
Figure 8:
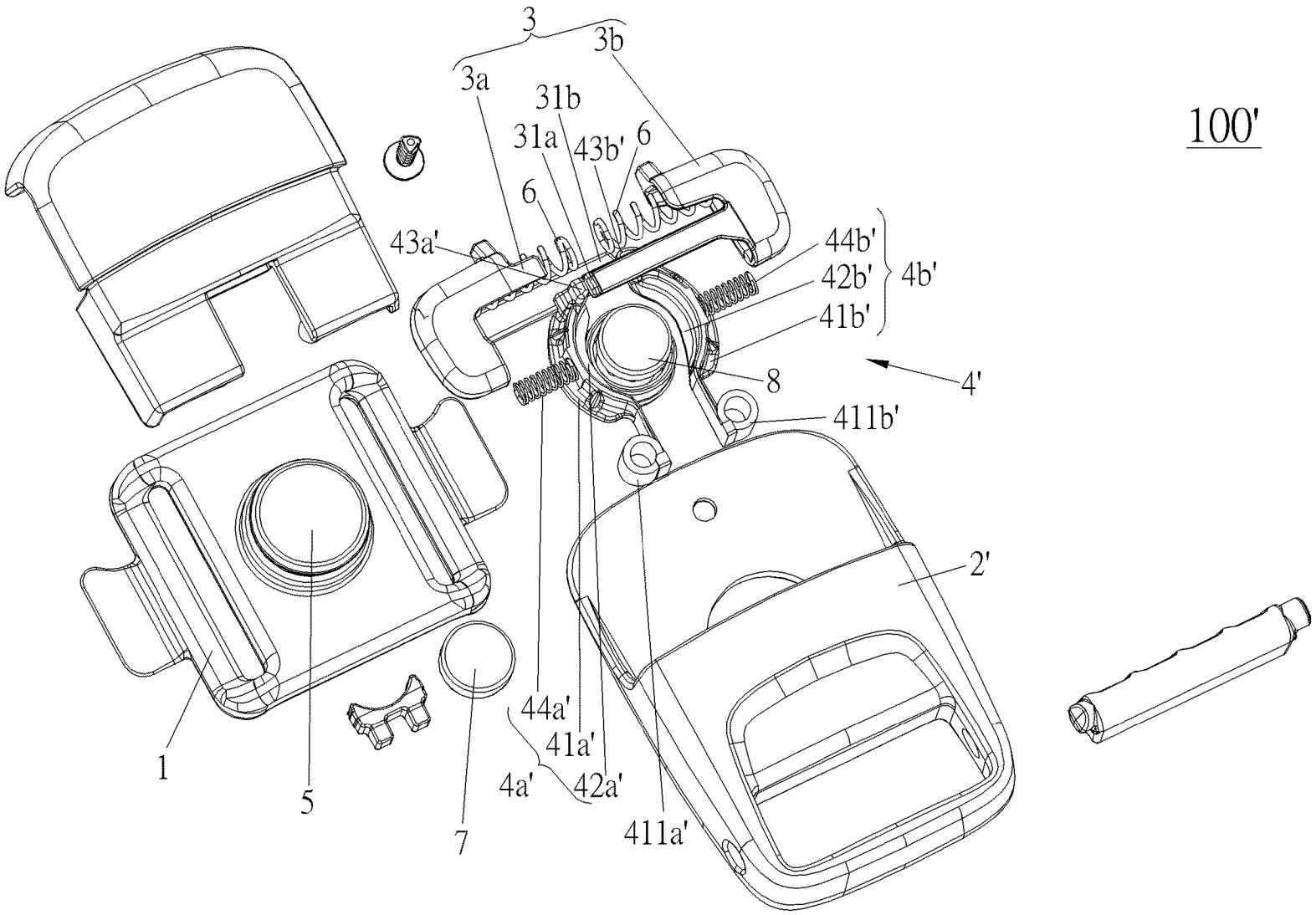
FIG. 8 is an exploded diagram of the buckle assembly according to the second embodiment of the present invention.
Figure 9:
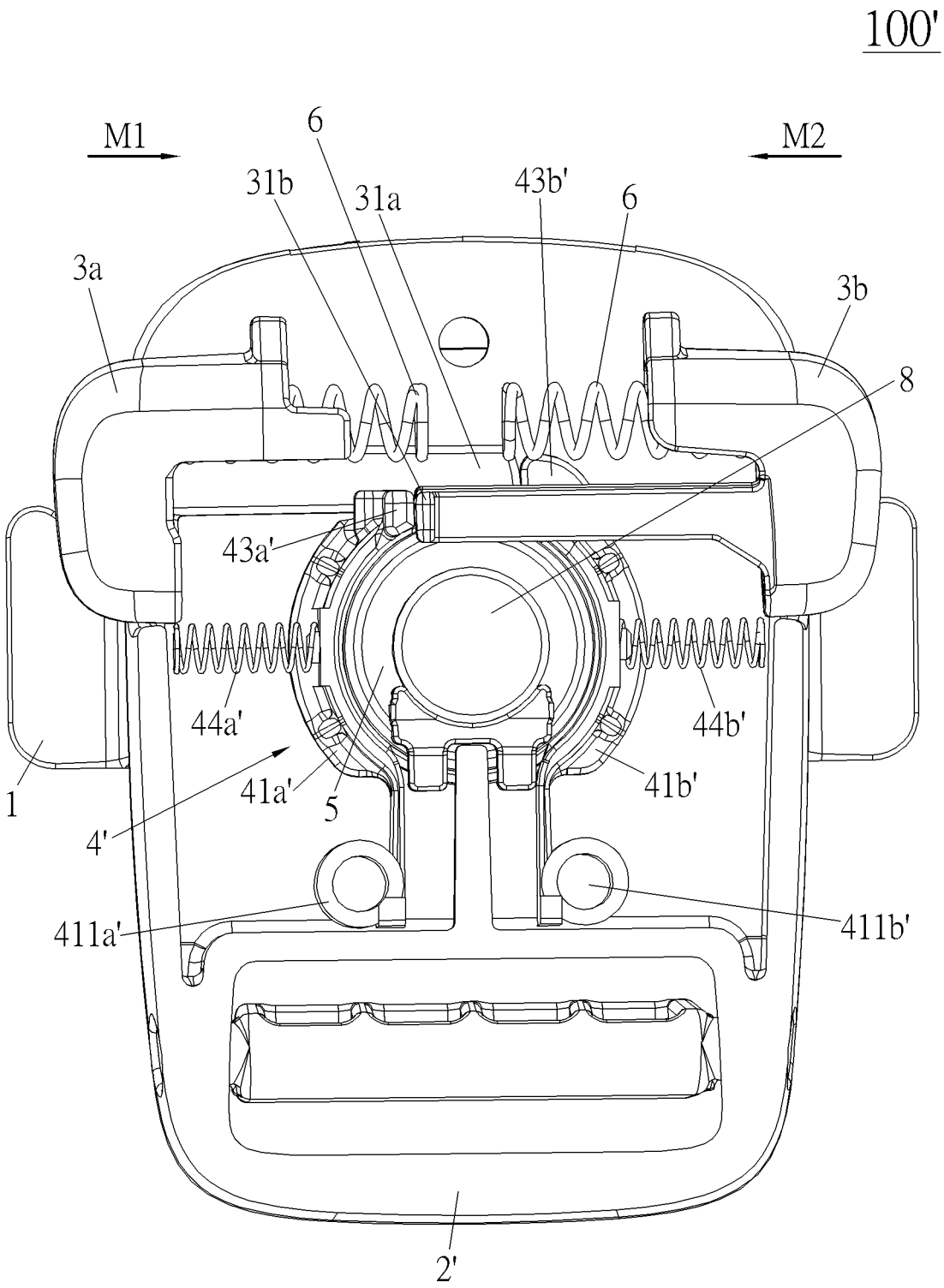
FIG. 9 and FIG. 10 are diagrams of the buckle assembly in different states according to the second embodiment of the present invention.
Figure 10:
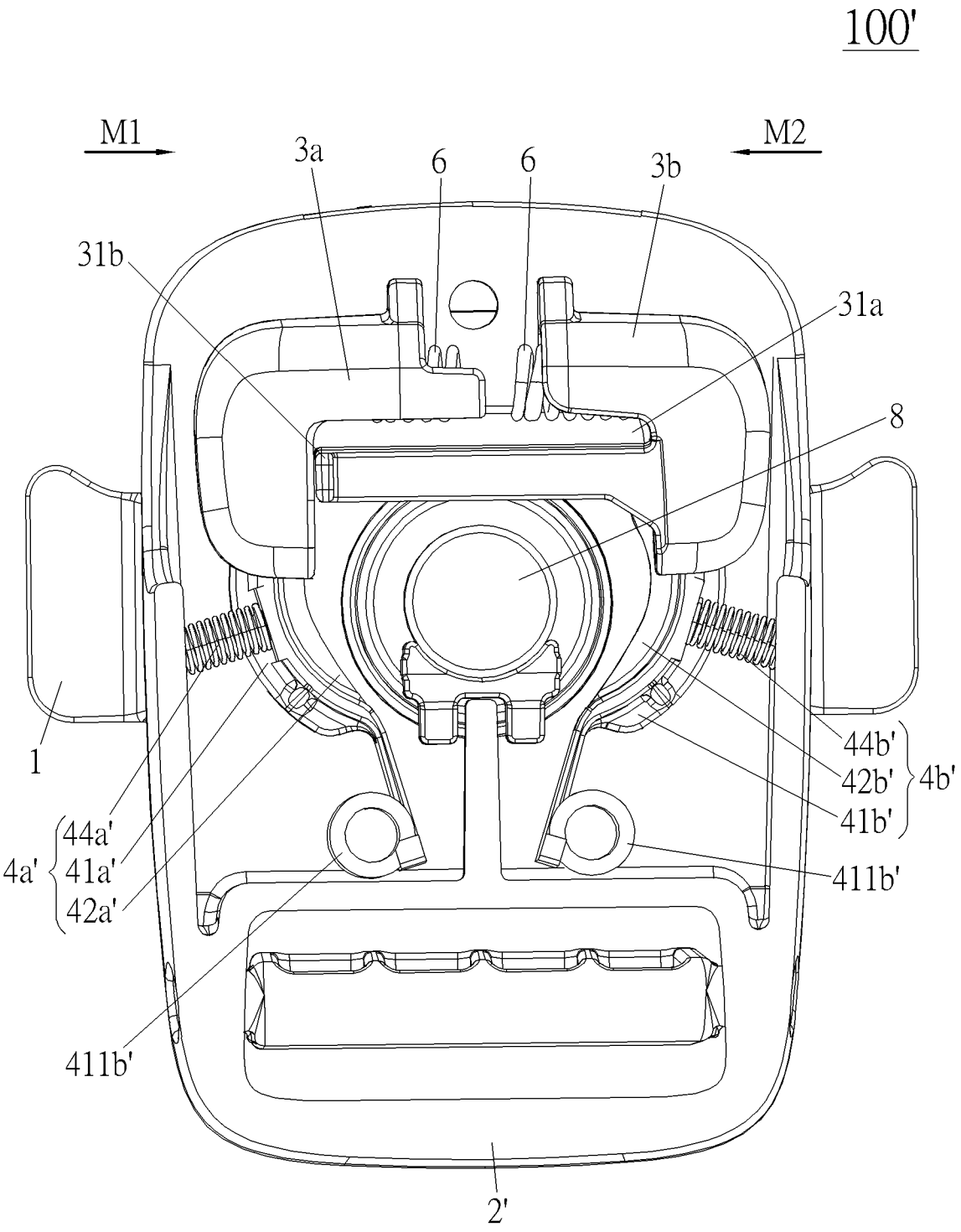

Please refer to FIG. 7 to FIG. 10. FIG. 7 is a schematic diagram of a buckle assembly 100' according to a second embodiment of the present invention. FIG. 8 is an exploded diagram of the buckle assembly 100' according to the second embodiment of the present invention. FIG. 9 and FIG. 10 are diagrams of the buckle assembly 100' in different states according to the second embodiment of the present invention. As shown in FIG. 7 to FIG. 10, the buckle assembly 100' includes the first buckle component 1, a second buckle component 2', the operating component 3, the two resilient components 6, the first magnetic structure 7 and the second magnetic structure 8. Structures of the first buckle component 1, the operating component 3, the resilient component 6, the first magnetic structure 7 and the second magnetic structure 8 of this embodiment are similar to the ones of the first embodiment. Detailed description is omitted herein for simplicity. The second buckle component 2' includes a locking portion 4'. The locking portion 4' includes a first locking portion 4*a*' and a second locking portion 4*b*'. The first locking portion 4*a*' and the second locking portion 4*b*' are located at the two opposite sides of the locked portion 5 of the first buckle component 1 and clamp the locked portion 5 along the lateral direction, which can be the arrow direction M1 or M2 shown in FIG. 9 and FIG. 10. The first locking portion 4*a*' and the first operating component 3*a* of the operating component 3 are located at a same side. The first locking portion 4*a*' is configured to cooperate with the second operating component 3*b* of the operating component 3. The second locking portion 4*b*' and the second operating component 3*b* of the operating component 3 are located at another same side. The second locking portion 4*b*' is configured to cooperate with the first operating component 3*a* of the operating component 3.

Specifically, the first locking portion 4*a*' includes a first rotating arm 41*a*' and a first locking head 42*a*'. The first locking head 42*a*' is configured to engage with the locked portion 5. The first rotating arm 41*a*' is pivotally connected to the second buckle component 2' by a first pivoting portion 411*a*'. A first cooperating portion 43*a*' is formed on the first rotating arm 41*a*' and for cooperating with the second abutting portion 31*b* of the second operating component 3*b*. The first cooperating portion 43*a*' is aligned with the second abutting portion 31*b* along the lateral direction. The first locking head 42*a*' is connected to the first rotating arm 41*a*' and protrudes from an inner wall of the first rotating arm 41*a*' along the lateral direction. The second locking portion 4*b*' includes a second rotating arm 41*b*' and a second locking head 42*b*'. The second locking head 42*b*' is configured to engage with the locked portion 5. The second rotating arm 41*b*' is pivotally connected to the second buckle component 2' by a second pivoting portion 411*b*'. A second cooperating portion 43*b*' is formed on the second rotating arm 41*b*' and for cooperating with the first abutting portion 31*a* of the first operating component 3*a*. The second cooperating portion 43*b*' is aligned with the first abutting portion 31*a* along the lateral direction. The second locking head 42*b*' is connected to the second rotating arm 41*b*' and protrudes from an inner wall of the second rotating arm 41*b*' along the lateral direction.

In this embodiment, the first cooperating portion 43*a*' and the second cooperating portion 43*b*' can be located at different levels along the up-down direction, and the first cooperating portion 43*a*' can be misaligned with the second cooperating portion 43*b*' along the lateral direction, which prevents any structural interface during a release operation of the buckle assembly 100' to ensure reliability of the release operation of the buckle assembly 100' and allows a reasonable use of an internal space of the buckle assembly 100'. Preferably, in this embodiment, the first pivoting portion 411*a*' and the second pivoting portion 411*b*' can be two slot structures for allowing two pivoting shafts of the second buckle component 2' to pass therethrough.

Furthermore, the first locking portion 4*a*' further includes a first recovering component 44*a*'. The second locking portion 4*b*' further includes a second recovering component 44*b*'. The first recovering component 44*a*' is disposed between the first rotating arm 41*a*' and the second buckle component 2' and for biasing the first rotating arm 41*a*' to rotate to engage the first locking head 42*a*' with the locked portion 5 along the lateral direction. The second recovering component 44*b*' is disposed between the second rotating arm 41*b*' and the second buckle component 2' and for biasing the second rotating arm 41*b*' to rotate to engage the second locking head 42*b*' with the locked portion 5 along the lateral direction. Preferably, in this embodiment, the first recovering component 44*a*' and the second recovering component 44*b*' can be two compressed springs. However, it is not limited thereto. For example, in another embodiment, the first recovering component and the second recovering component can be two torsional springs.

When it is desired to release the buckle assembly 100', the first operating component 3*a* and the second operating component 3*b* of the operating component 3 can be pressed or operated to respectively drive the second rotating arm 41*b*' and the first rotating arm 41*a*' by abutment of the first abutting portion 31*a* of the first operating component 3*a* and the second cooperating portion 43*b*' of the second locking portion 4*b*' and abutment of the second abutting portion 31*b* of the second operating component 3*b* and the first cooperating portion 43*a*' of the first locking arm 4*a*', so as to resiliently compress the second recovering component 44*b*' and the first recovering component 44*a*' for disengaging the second locking head 42*b*' and the first locking head 42*a*' from the locked portion 5. When the second locking head 42*b*' and the first locking head 42*a*' are disengaged from the locked portion 5, i.e., the buckle assembly 100' is in the releasing state, the first buckle component 1 can be separated from the second buckle component 2' to locate the buckle assembly 100' in a separation state. Afterwards, when the first operating component 3*a* and the second operating component 3*b* are released, the two resilient components 6 drive the first operating component 3*a* and the second operating component 3*b* to recover.

When it is desired to engage the first buckle component 1 with the second buckle component 2', the locked portion 5 can be inserted into a mating hole of the second buckle component 2' so as to abut against the first locking head 42*a*' and the second locking head 42*b*' by the abutting structure 51 to drive the first rotating arm 41*a*' and the second rotating arm 41*b*' to rotate to resiliently compress the first recovering component 44*a*' and the second recovering component 44*b*' for allowing the abutting structure 51 to pass across the first locking head 42*a*' and the second locking head 42*b*'. When the abutting structure 51 passes across the first locking head 42*a*' and the second locking head 42*b*' to align the locked structure 52 with the first locking head 42*a*' and the second locking head 42*b*', the first locking head 42*a*' and the second locking head 42*b*' can be driven by the first recovering component 44*a*' and the second recovering component 44*b*' to engage with the locked structure 52.

It is understandable that, in another embodiment, when there is only one locking portion located at one side of the locked portion and for engaging with the locked portion, there can be only one operating component located at another side of the locked portion opposite to the locking portion to resiliently push the locking portion away from the locked portion for disengaging the locking portion from the locked portion. In other words, the operating component and the locking portion can be located at two opposite sides of the locked portion to push the locking portion by the operating component for disengaging the locking portion from the locked portion. Alternatively, in another embodiment, the operating component and the locking portion can be located at a same side of the locked portion for pulling the locking portion by the operating component for disengaging the locking portion from the locked portion.

Figure 11:
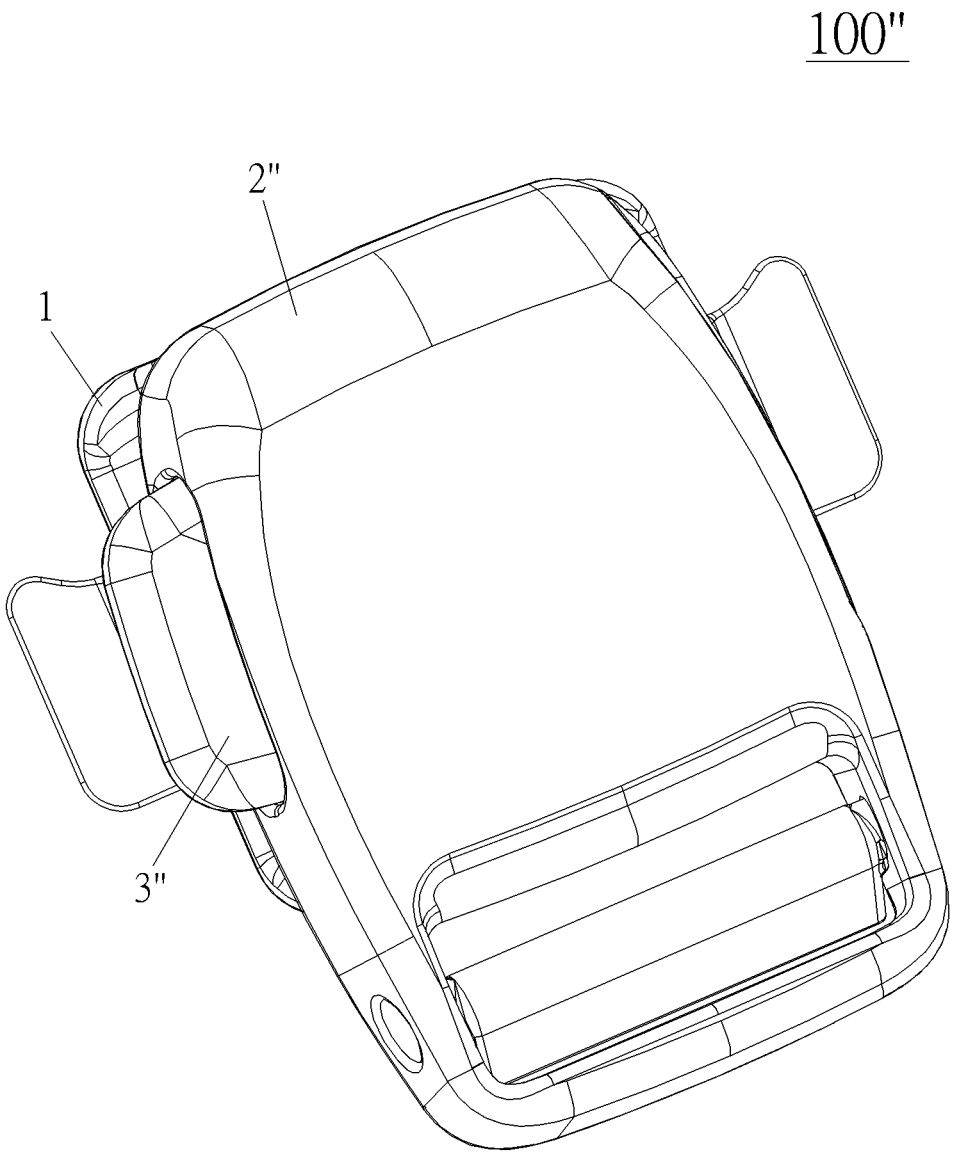
FIG. 11 is a schematic diagram of a buckle assembly according to a third embodiment of the present invention.
Figure 12:
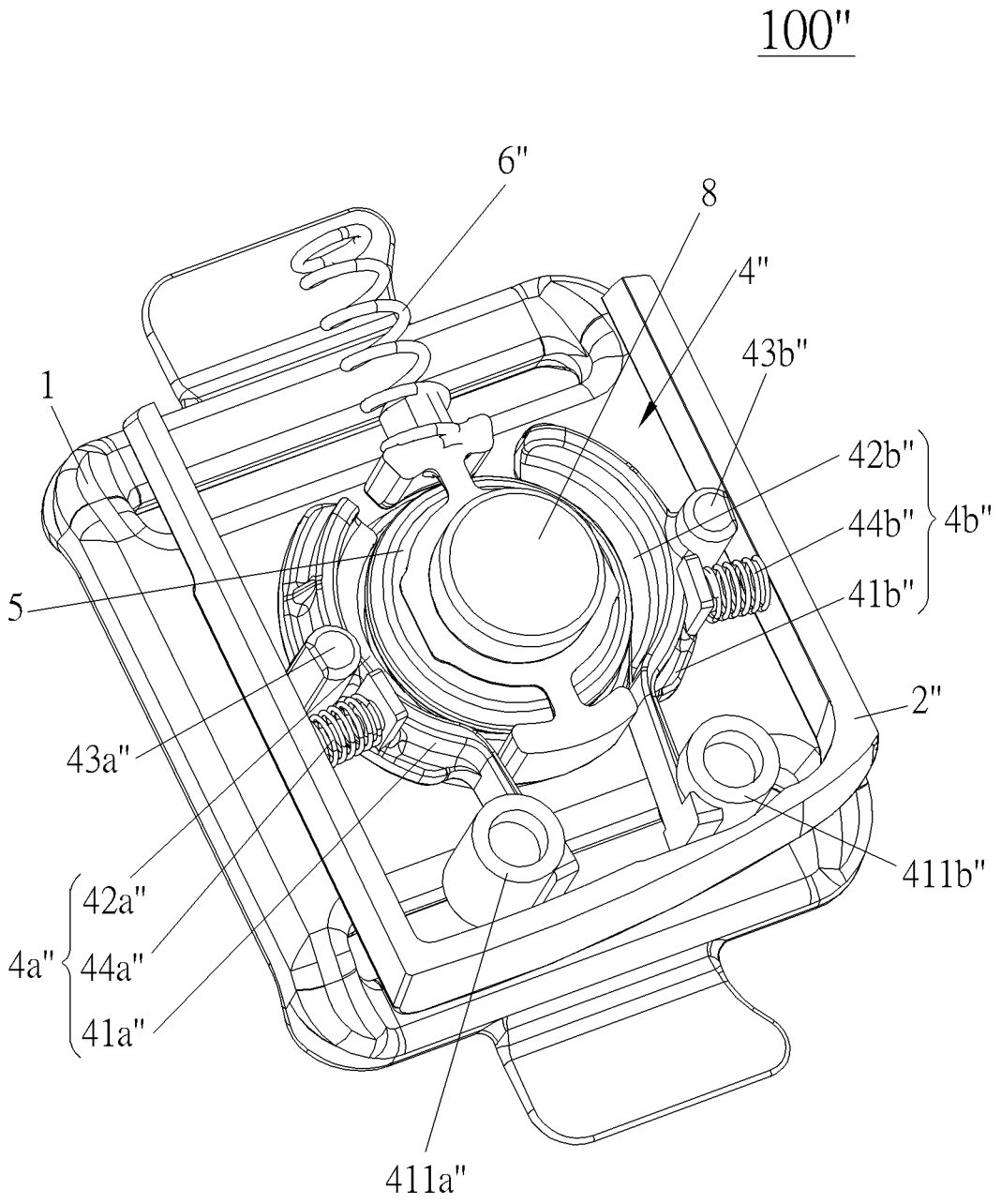
FIG. 12 is a partial diagram of the buckle assembly according to the third embodiment of the present invention.
Figure 13:
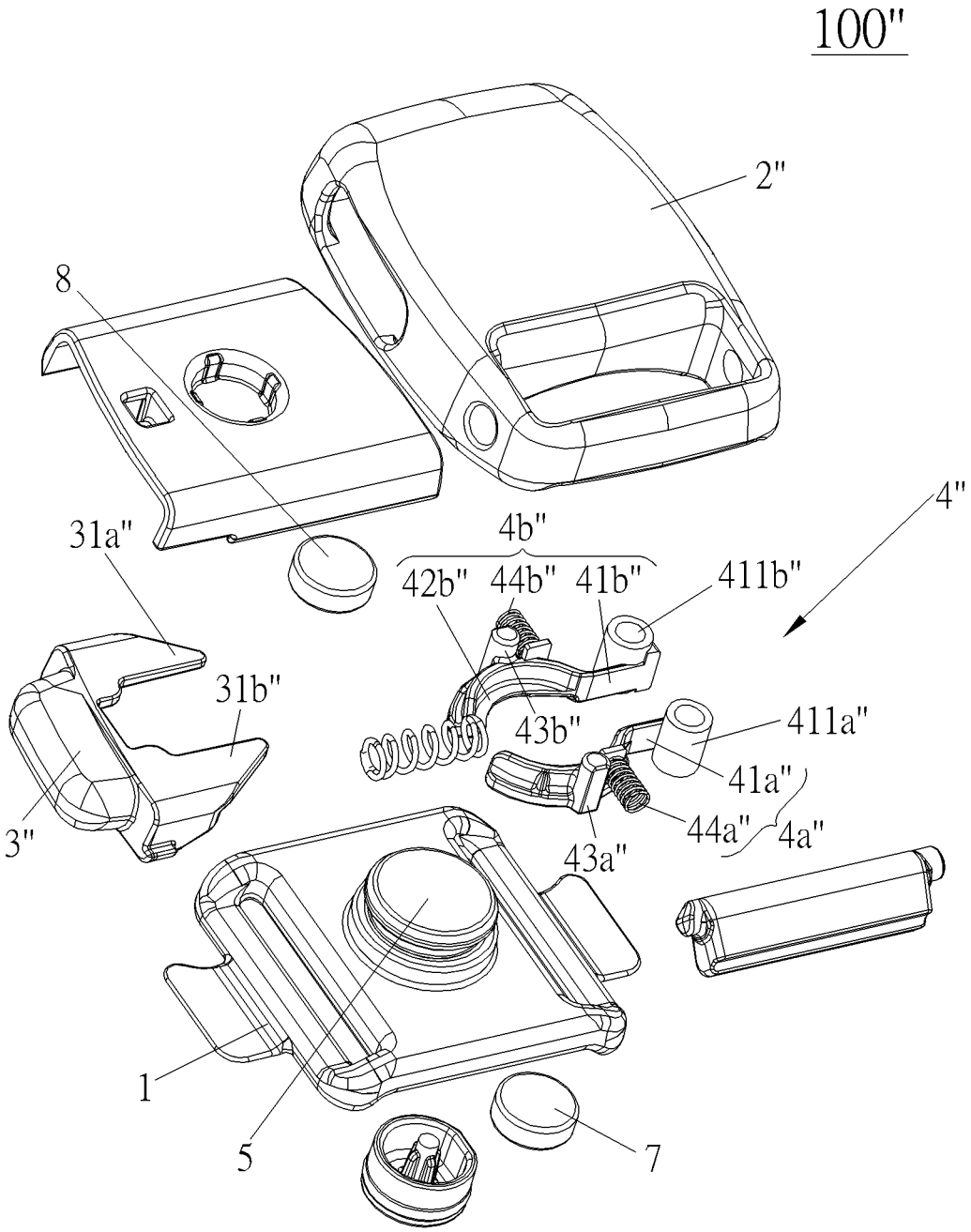
FIG. 13 is an exploded diagram of the buckle assembly according to the third embodiment of the present invention.
Figure 14:
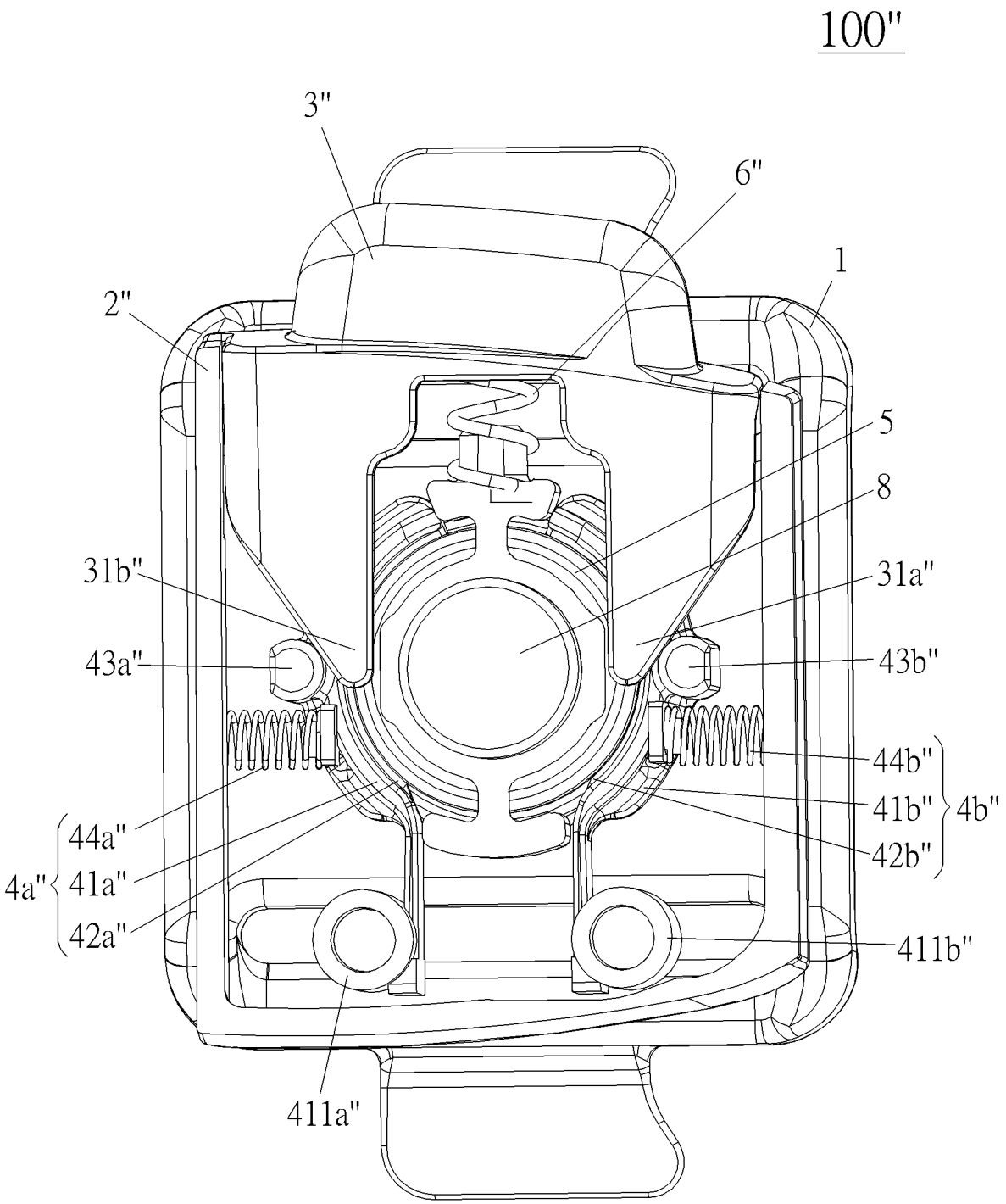
FIG. 14 and FIG. 15 are diagrams of the buckle assembly in different states according to the third embodiment of the present invention.
Figure 15:
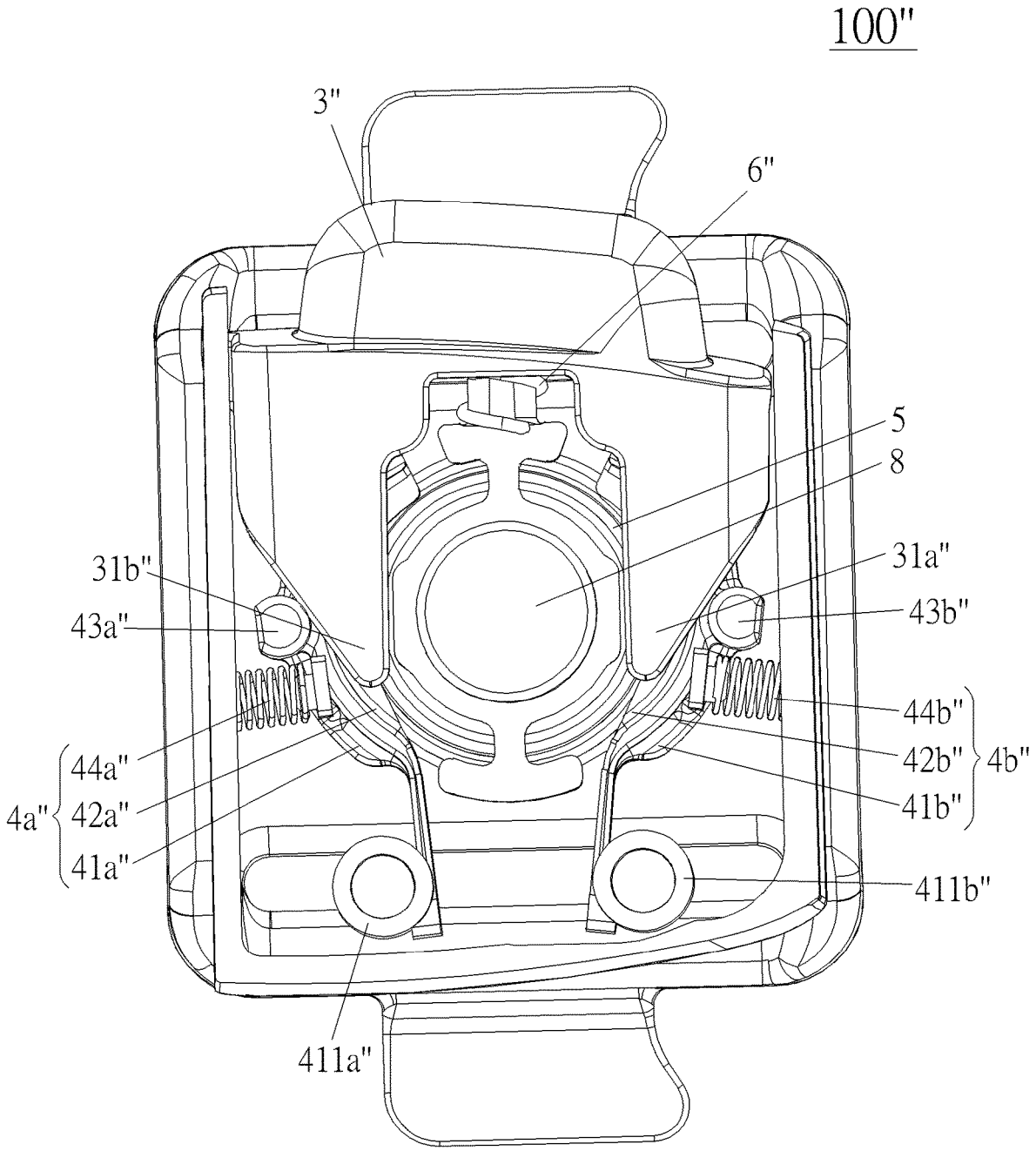
Figure 16:
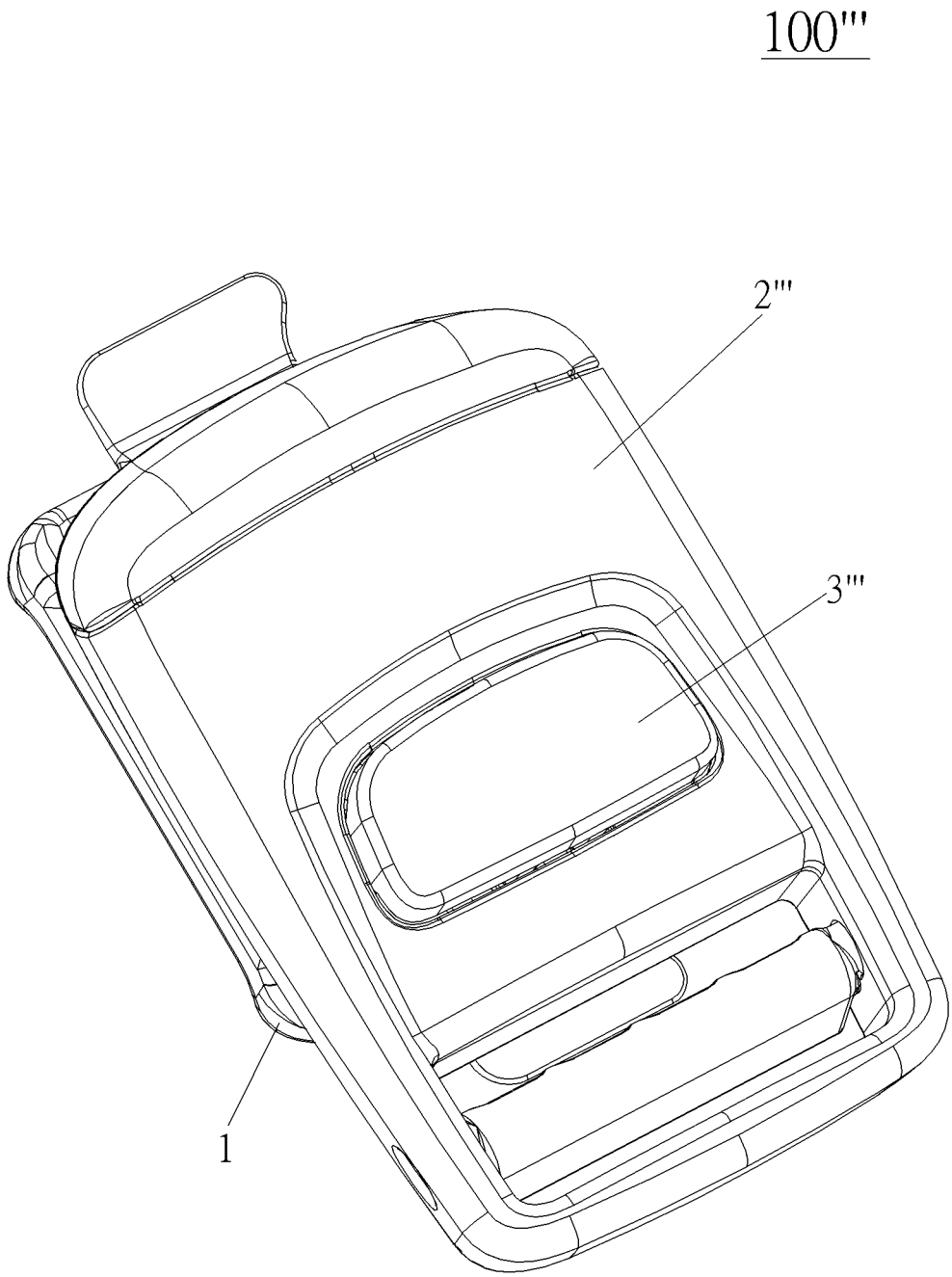
FIG. 16 is a schematic diagram of a buckle assembly according to a fourth embodiment of the present invention.

Please refer to FIG. 11 to FIG. 15. FIG. 11 is a schematic diagram of a buckle assembly 100" according to a third embodiment of the present invention. FIG. 12 is a partial diagram of the buckle assembly 100" according to the third embodiment of the present invention. FIG. 13 is an exploded diagram of the buckle assembly 100" according to the third embodiment of the present invention. FIG. 14 and FIG. 15 are diagrams of the buckle assembly 100" in different states according to the third embodiment of the present invention. As shown in FIG. 11 to FIG. 15, the buckle assembly 100" includes the first buckle component 1, a second buckle component 2", an operating component 3", a resilient component 6", the first magnetic structure 7 and the second magnetic structure 8. Structures of the first buckle component 1, the first magnetic structure 7 and the second magnetic structure 8 of this embodiment are similar to the ones of the first embodiment. Detailed description is omitted herein for simplicity. The second buckle component 2" includes a locking portion 4". The locking portion 4" includes a first locking portion 4*a*" and a second locking portion 4*b*". The first locking portion 4*a*" and the second locking portion 4*b*" are located at the two opposite sides of the locked portion 5 of the first buckle component 1 and clamp the locked portion 5 along the lateral direction, which can be the arrow direction M1 or M2 shown in FIG. 14 and FIG. 15. The operating component 3" is exposed out of a lateral wall of the second buckle component 2" and slidable relative to the second buckle component 2" along the extending direction which can be the arrow direction Q shown in FIG. 14 and FIG. 15. A first abutting portion 31*a*" and a second abutting portion 31*b*" protrude from the operating component 3" along the extending direction. The first locking portion 4*a*" and the second abutting portion 31*b*" are located at a same side and configured to cooperate with each other. The second locking portion 4*b*" and the first abutting portion 31*a*" are located at another same side and configured to cooperate with each other. The resilient component 6" is disposed between the operating component 3" and the second buckle component 2".

Specifically, the first locking portion 4*a*" includes a first rotating arm 41*a*" and a first locking head 42*a*". The first locking head 42*a*" is configured to engage with the locked portion 5. The first rotating arm 41*a*" is pivotally connected to the second buckle component 2" by a first pivoting portion 411*a*". A first cooperating portion 43*a*" is formed on the first rotating arm 41*a*" and for cooperating with the second abutting portion 31*b*". The first cooperating portion 43*a*" is aligned with the second abutting portion 31*b*" along the extending direction. The first locking head 42*a*" is connected to the first rotating arm 41*a*" and protrudes from an inner wall of the first rotating arm 41*a*" along the lateral direction. The second locking portion 4*b*" includes a second rotating arm 41*b*" and a second locking head 42*b*". The second locking head 42*b*" is configured to engage with the locked portion 5. The second rotating arm 41*b*" is pivotally connected to the second buckle component 2" by a second pivoting portion 411*b*". A second cooperating portion 43*b*" is formed on the second rotating arm 41*b*" and for cooperating with the first abutting portion 31*a*". The second cooperating portion 43*b*" is aligned with the first abutting portion 31*a*" along the extending direction. The second locking head 42*b*" is connected to the second rotating arm 41*b*" and protrudes from an inner wall of the second rotating arm 41*b*" along the lateral direction. Preferably, in this embodiment, the first pivoting portion 411*a*" and the second pivoting portion 411*b*" can be two slot structures for allowing two pivoting shafts to pass therethrough.

Furthermore, the first locking portion 4*a*" further includes a first recovering component 44*a*". The second locking portion 4*b*" further includes a second recovering component 44*b*". The first recovering component 44*a*" is disposed between the first rotating arm 41*a*" and the second buckle component 2" and for biasing the first rotating arm 41*a*" to rotate to engage the first locking head 42*a*" with the locked portion 5 along the lateral direction. The second recovering component 44*b*" is disposed between the second rotating arm 41*b*" and the second buckle component 2" and for biasing the second rotating arm 41*b*" to rotate to engage the second locking head 42*b*" with the locked portion 5 along the lateral direction. Preferably, in this embodiment, the first recovering component 44*a*" and the second recovering component 44*b*" can be two compressed springs. However, it is not limited thereto. For example, in another embodiment, the first recovering component and the second recovering component can be two torsional springs.

When it is desired to release the buckle assembly 100", the operating component 3" can be pressed or operated to respectively drive the first rotating arm 41*a*" and the second rotating arm 41*b*" by abutment of the second abutting portion 31*b*" and the first cooperation portion 43*a*" of the first locking portion 4*a*" and abutment of the first abutting portion 31*a*" and the second cooperating portion 43*b*" of the second locking portion 4*b*", so as to resiliently compress the first recovering component 44*a*" and the second recovering component 44*b*" for disengaging the first locking head 42*a*" and the second locking head 42*b*" from the locked portion 5. When the first locking head 42*a*" and the second locking head 42*b*" are disengaged from the locked portion 5, i.e., the buckle assembly 100" is in the releasing state, the first buckle component 1 can be separated from the second buckle component 2" to locate the buckle assembly 100" in a separation state. Afterwards, when the operating component 3" is released, the resilient component 6 drives the operating component 3" to recover.

When it is desired to engage the first buckle component 1 with the second buckle component 2", the locked portion 5 can be inserted into a mating hole of the second buckle component 2" so as to abut against the first locking head 42*a*" and the second locking head 42*b*" by the abutting structure 51 to drive the first rotating arm 41*a*" and the second rotating arm 41*b*" to rotate to resiliently compress the first recovering component 44*a*" and the second recovering component 44*b*" for allowing the abutting structure 51 to pass across the first locking head 42*a*" and the second locking head 42*b*". When the abutting structure 51 passes across the first locking head 42*a*" and the second locking head 42*b*" to align the locked structure 52 with the first locking head 42*a*" and the second locking head 42*b*", the first locking head 42*a*" and the second locking head 42*b*" can be driven by the first recovering component 44*a*" and the second recovering component 44*b*" to engage with the locked structure 52.

It is understandable that, in another embodiment, when there is only one locking portion located at one side of the locked portion and for engaging with the locked portion, there can be only one abutting portion for pushing the rotating arm to rotate to resiliently deform the recovering component for disengaging the locking portion from the locked portion. Alternatively, in another embodiment, the operating component can be configured to pull the rotating arm to rotate for disengaging the locking portion from the locked portion.

Figure 17:
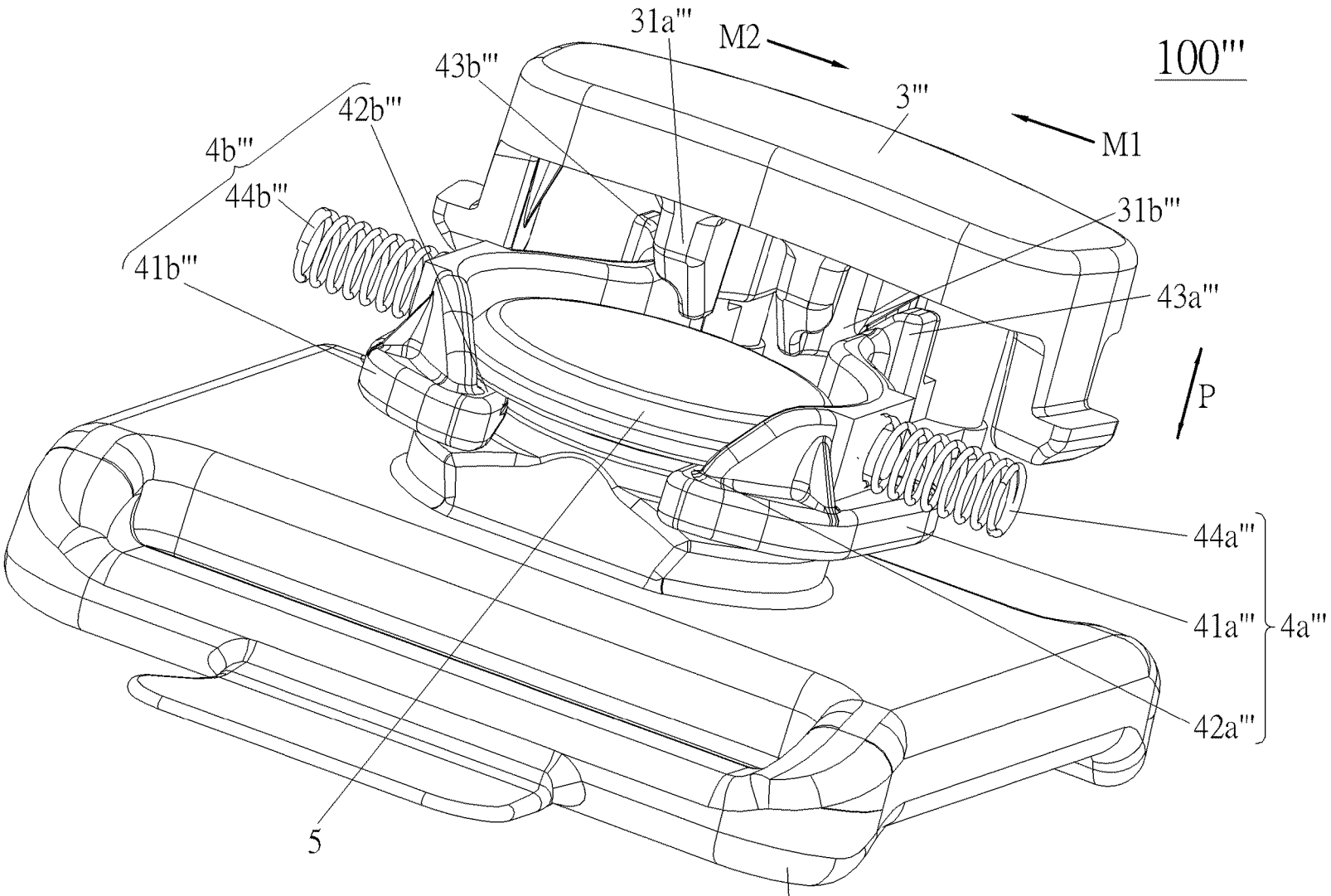
FIG. 17 is a partial diagram of the buckle assembly according to the fourth embodiment of the present invention.
Figure 18:
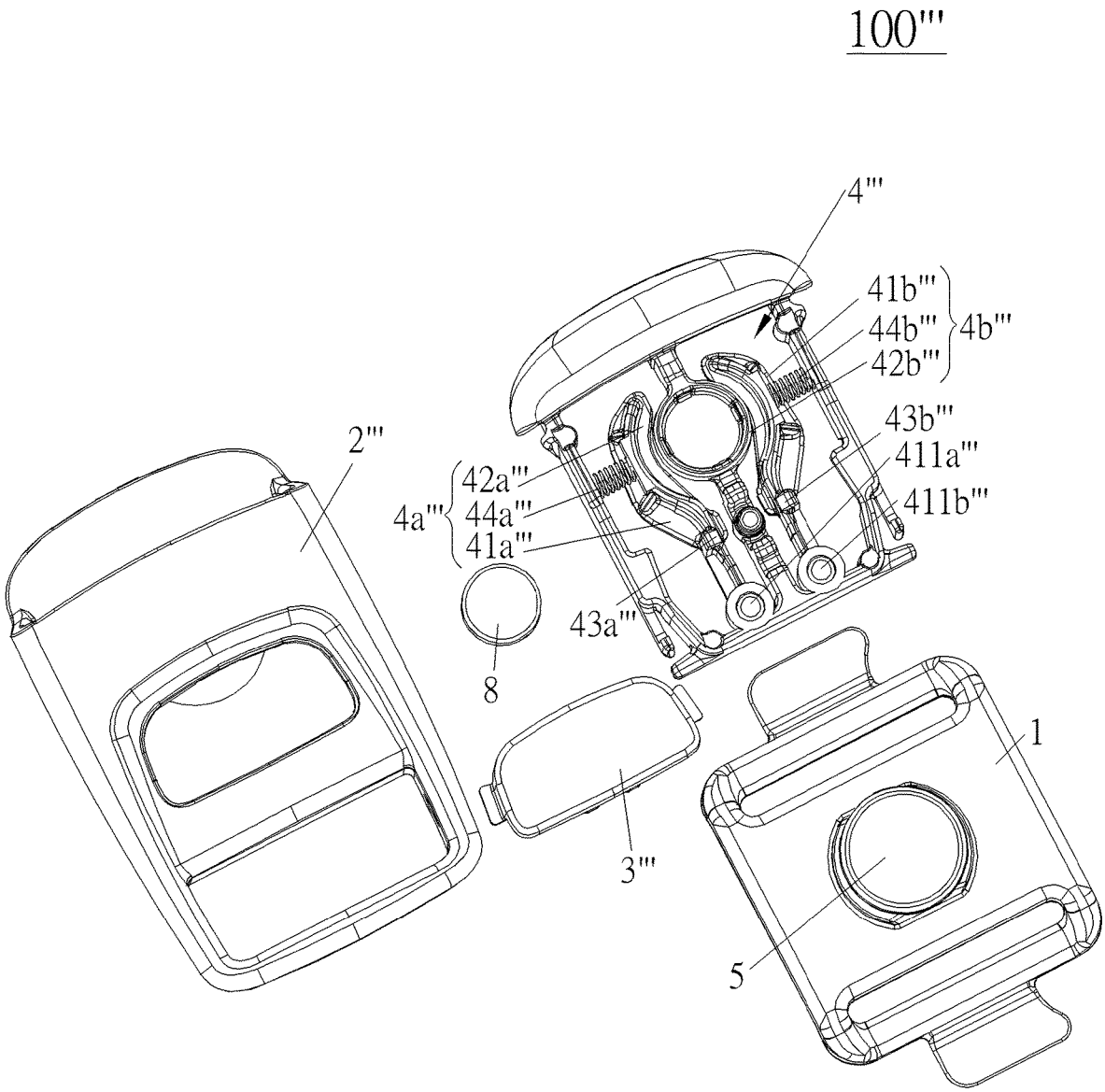
FIG. 18 is an exploded diagram of the buckle assembly according to the fourth embodiment of the present invention.
Figure 19:
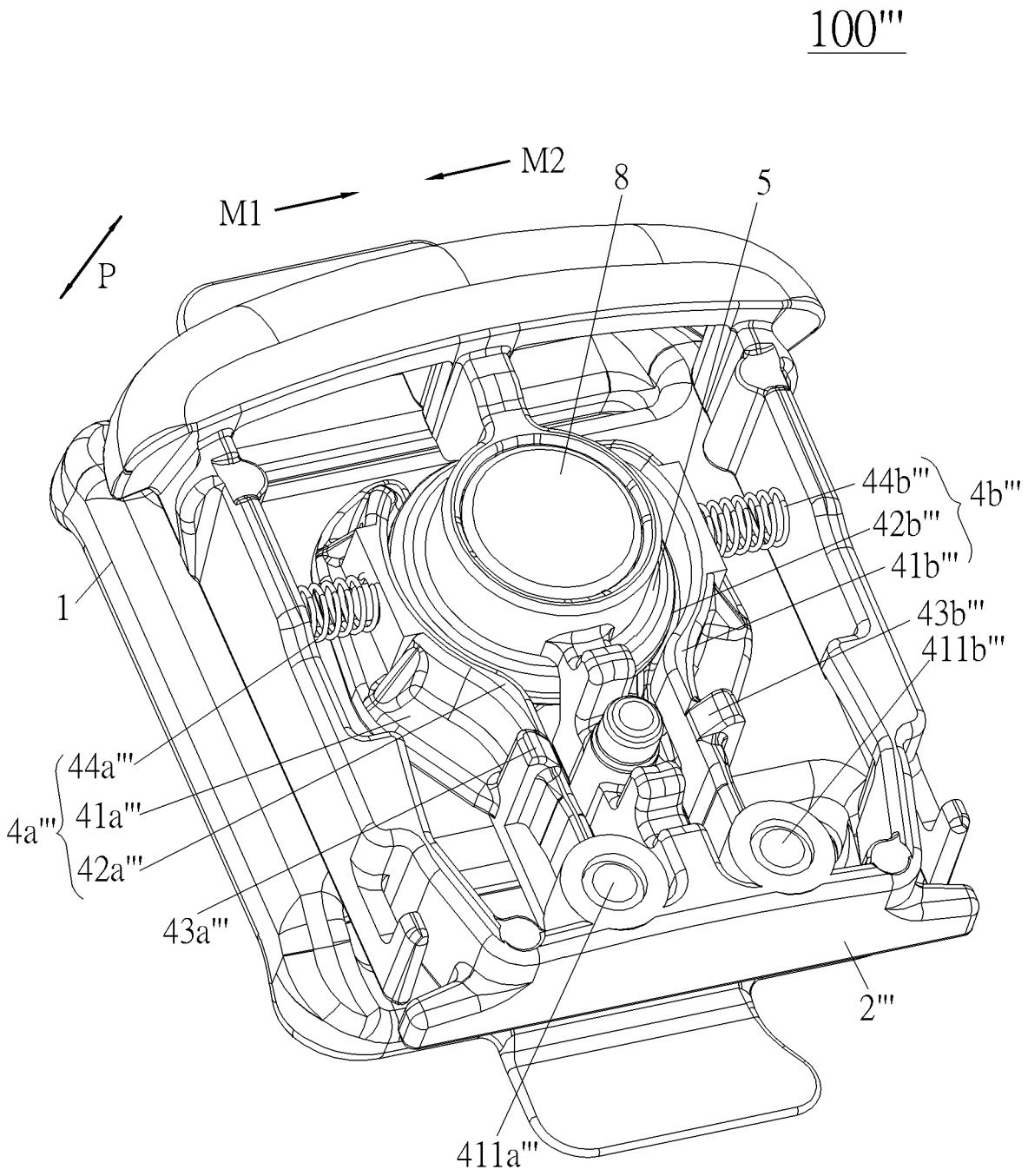
FIG. 19 and FIG. 20 are diagrams of the buckle assembly in different states according to the fourth embodiment of the present invention.
Figure 20:
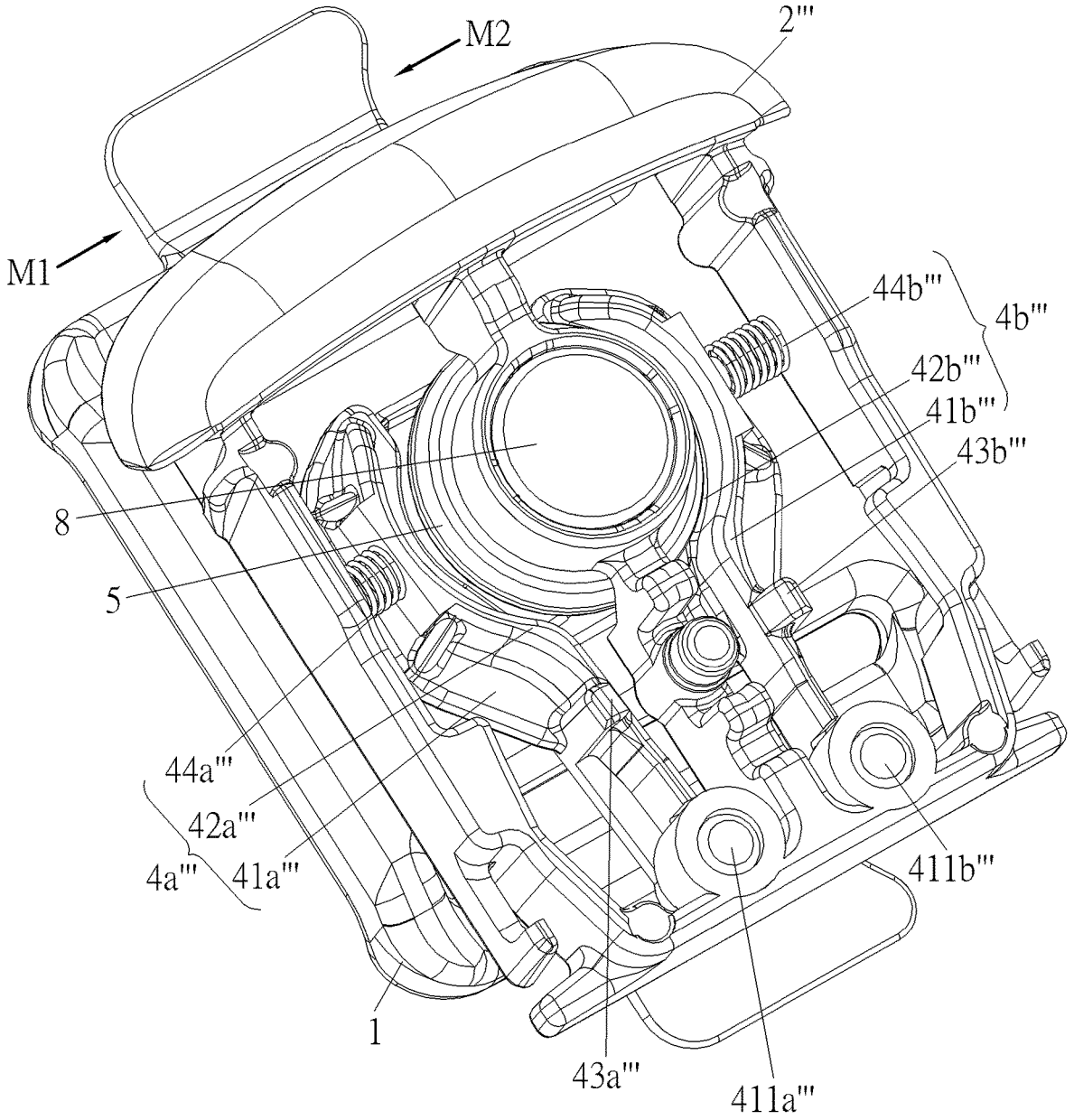

Please refer to FIG. 17 to FIG. 20. FIG. 17 is a partial diagram of the buckle assembly 100' according to the fourth embodiment of the present invention. FIG. 18 is an exploded diagram of the buckle assembly 100' according to the fourth embodiment of the present invention. FIG. 19 and FIG. 20 are diagrams of the buckle assembly 100' in different states according to the fourth embodiment of the present invention. As shown in FIG. 17 to FIG. 20, the buckle assembly 100' includes the first buckle component 1, a second buckle component 2', an operating component 3', a resilient component which is not shown in the figures, a first magnetic structure which is not shown in the figures, and the second magnetic structure 8. Structures of the first buckle component 1, the first magnetic structure and the second magnetic structure 8 of this embodiment are similar to the ones of the first embodiment. Detailed description is omitted herein for simplicity. The second buckle component 2' includes a locking portion 4'. The locking portion 4' includes a first locking portion 4*a*' and a second locking portion 4*b*". The first locking portion 4*a*' and the second locking portion 4*b*" are located at the two opposite sides of the locked portion 5 of the first buckle component 1 and clamp the locked portion 5 along the lateral direction, which can be the arrow direction M1 or M2 shown in FIG. 17. The operating component 3' is exposed out of a front wall of the second buckle component 2' and slidable relative to the second buckle component 2' along the mating direction which can be the arrow direction P shown in FIG. 17. A first abutting portion 31*a*" and a second abutting portion 31*b*" protrude from the operating component 3' along the mating direction. The first locking portion 4*a*' and the second abutting portion 31*b*" are located at a same side and configured to cooperate with each other. The second locking portion 4*b*" and the first abutting portion 31*a*" are located at another same side and configured to cooperate with each other. The resilient component is disposed between the operating component 3' and the second buckle component 2'.

Specifically, the first locking portion 4*a*' includes a first rotating arm 41*a*'" and a first locking head 42*a*'. The first locking head 42*a*'" is configured to engage with the locked portion 5. The first rotating arm 41*a*'" is pivotally connected to the second buckle component 2' by a first pivoting portion 411*a*.'". A first cooperating portion 43*a*' is formed on the first rotating arm 41*a*'" and for cooperating with the second abutting portion 31*b*'". The first cooperating portion 43*a*'" is aligned with the second abutting portion 31*b*'" along the mating direction. The first locking head 42*a*' is connected to the first rotating arm 41*a*'" and protrudes from an inner wall of the first rotating arm 41*a*" along the lateral direction. The second locking portion 4*b*'" includes a second rotating arm 41*b*'" and a second locking head 42*b*'". The second locking head 42*b*'" is configured to engage with the locked portion 5. The second rotating arm 41*b*'" is pivotally connected to the second buckle component 2' by a second pivoting portion 411*b*'". A second cooperating portion 43*b*'" is formed on the second rotating arm 41*b*'" and for cooperating with the first abutting portion 31*a*'". The second cooperating portion 43*b*'" is aligned with the first abutting portion 31*a*'" along the mating direction. The second locking head 42*b*'" is connected to the second rotating arm 41*b*'" and protrudes from an inner wall of the second rotating arm 41*b*'" along the lateral direction. Preferably, in this embodiment, the first pivoting portion 411*a*'" and the second pivoting portion 411*b*'" can be two pivoting shafts for passing through two slot structures formed on the second buckle component 2'.

Furthermore, the first locking portion 4*a*' further includes a first recovering component 44*a*". The second locking portion 41D'" further includes a second recovering component 44*b*'". The first recovering component 44*a*' is disposed between the first rotating arm 41*a*'" and the second buckle component 2' and for biasing the first rotating arm 41*a*'" to rotate to engage the first locking head 42*a*'" with the locked portion 5 along the lateral direction. The second recovering component 44*b*'" is disposed between the second rotating arm 41*b*'" and the second buckle component 2' and for biasing the second rotating arm 41*b*'" to rotate to engage the second locking head 42*b*'" with the locked portion 5 along the lateral direction.

When it is desired to release the buckle assembly 100", the operating component 3'" can be pressed or operated to respectively drive the first rotating arm 41*a*'" and the second rotating arm 41*b*'" by abutment of the second abutting portion 31*b*'" and the first cooperating portion 43*a*" of the first locking portion 4*a*' and abutment of the first abutting portion 31*a*" and the second cooperating portion 43*b*'" of the second locking portion 4*b*", so as to resiliently compress the first recovering component 44*a*'" and the second recovering component 44*b*'" for disengaging the first locking head 42*a*'" and the second locking head 42*b*'" from the locked portion 5. When the first locking head 42*a*'" and the second locking head 42*b*'" are disengaged from the locked portion 5, i.e., the buckle assembly 100" is in the releasing state, the first buckle component 1 can be separated from the second buckle component 2'" to locate the buckle assembly 100" in a separation state. Afterwards, when the operating component 3'" is released, the resilient component drives the operating component 3'" to recover.

When it is desired to engage the first buckle component 1 with the second buckle component 2", the locked portion 5 can be inserted into a mating hole of the second buckle component 2'" so as to abut against the first locking head 42*a*'" and the second locking head 42*b*'" by the abutting structure 51 to drive the first rotating arm 41*a*'" and the second rotating arm 41*b*'" to rotate to resiliently compress the first recovering component 44*a*'" and the second recovering component 44*b*'" for allowing the abutting structure 51 to pass across the first locking head 42*a*'" and the second locking head 42*b*". When the abutting structure 51 passes across the first locking head 42*a*'" and the second locking head 42*b*'" to align the locked structure 52 with the first locking head 42*a*'" and the second locking head 42*b*"% the first locking head 42*a*'" and the second locking head 42*b*'" can be driven by the first recovering component 44*a*'" and the second recovering component 44*b*'" to engage with the locked structure 52.

It is understandable that, in another embodiment, when there is only one locking portion located at one side of the locked portion and for engaging with the locked portion, there can be only one abutting portion for pushing the rotating arm to rotate to resiliently deform the recovering component for disengaging the locking portion from the locked portion. Alternatively, in another embodiment, the operating component can be configured to pull the rotating arm to rotate for disengaging the locking portion from the locked portion.

In contrast to the prior art, in the present invention, the operating component is disposed on the second buckle component including the locking portion which cooperates with the locked portion of the first buckle component. The operating component drives the locking portion to disengage the locking portion from the locked portion when the operating component is operated. Therefore, the present invention has advantages of simple structure and labor-saving and easy operation.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A buckle assembly comprising:

a first buckle component comprising a locked portion;

a second buckle component comprising a locking portion configured to cooperate with the locked portion, the locking portion engaging with the locked portion along a lateral direction of the buckle assembly when the second buckle component is mated with the first buckle component along a mating direction;

an operating component partially embedded in the second buckle component and partially exposed out of the second buckle component, the operating component being configured to cooperate with the locking portion and slidable relative to the locking portion, the operating component driving the locking portion to move away from the locked portion for disengaging the locking portion from the locked portion during a sliding movement of the operating component relative to the locking portion; and a first magnetic structure and a second magnetic structure, the first magnetic structure being disposed on the first buckle component, the second magnetic structure being disposed on the second buckle component, and the first magnetic structure magnetically attracting or repelling the second magnetic structure during a mating process of the first buckle component and the second buckle component.

2. The buckle assembly of claim 1, wherein the locking portion is a resilient structure, and the operating component resiliently deforms the locking portion for disengaging the locking portion from the locked portion during the sliding movement of the operating component relative to the second buckle component.

3. The buckle assembly of claim 2, wherein the locking portion comprises a resilient arm and a locking head connected to the resilient arm, the resilient arm is configured to cooperate with the operating component, the locking head is configured to engage with the locked portion, the resilient arm is biased to engage the locking head with the locked portion, and the operating component resiliently deforms the resilient arm for disengaging the locking head from the locked portion during the sliding movement of the operating component relative to the second buckle component.

4. The buckle assembly of claim 3, wherein the operating component is slidable relative to the second buckle component along the lateral direction, an abutting portion protrudes from the operating component along the lateral direction, a cooperating portion is formed on a free end of the resilient arm and for cooperating with the abutting portion, and the operating component abuts against the cooperating portion by the abutting portion to resiliently deform the resilient arm for disengaging the locking head from the locked portion during the sliding movement of the operating component relative to the second buckle component.

5. The buckle assembly of claim 4 wherein the cooperating portion is aligned with the abutting portion along the lateral direction, and wherein the locking head protrudes from an inner wall of the resilient arm along the lateral direction, and the cooperating portion is adjacent to the locking head.

6. The buckle assembly of claim 5, wherein the locking head and the cooperating portion are sequentially arranged along a direction from a fixing end of the resilient arm toward the free end of the resilient arm.

7. The buckle assembly of claim 3, wherein the locking portion is detachably connected to the second buckle component.

8. The buckle assembly of claim 7, wherein the locking portion further comprises an engaging bracket fixedly connected to a fixing end of the resilient arm, an engaged structure is formed on the second buckle component and for detachably engaging with the engaging bracket, and the engaging bracket is detachably embedded into the engaged structure.

9. The buckle assembly of claim 8, wherein the engaged structure comprises at least two engaged rods spaced apart from each other, the engaging bracket is embedded between the at least two engaged rods, each of the at least two engaged rods comprises an upper restraining part and a lower restraining part, the upper restraining part and the lower restraining part are configured to restrain movement of the engaging bracket, and the engaging bracket is located between the upper restraining part and the lower restraining part when the engaging bracket is detachably embedded into the engaged structure.

10. The buckle assembly of claim 9, wherein the engaging bracket comprises a step-shaped structure for engaging with the lower restraining part when the engaging bracket is detachably embedded into the engaged structure.

11. The buckle assembly of claim 9, wherein an avoiding space is formed between the at least two engaged rods and for allowing the resilient arm to move.

12. The buckle assembly of claim 3, wherein the locked portion comprises an abutting structure and a locked structure, the abutting structure abuts against the locking head to resiliently deform the resilient arm during the mating process of the first buckle component and the second buckle component, the locked structure is configured to engage with the locking head, and the operating component resiliently deforms the resilient arm for disengaging the locking head from the locked structure during the sliding movement of the operating component relative to the second buckle component.

13. The buckle assembly of claim 12, wherein an end portion of the abutting structure comprises a first inclined part inclined relative to the mating direction, the locking head comprises a second inclined part for cooperating with the first inclined part, and the abutting structure resiliently deforms the resilient arm by abutment of the first inclined part and the second inclined part to pass across the locking head for engaging the locked structure with the locking head during the mating process of the first buckle component and the second buckle component.

14. The buckle assembly of claim 12, wherein the locked structure is an enclosed recess, and the locking head is configured to engage with the enclosed recess.

15. The buckle assembly of claim 2, wherein the locking portion comprises a first locking portion and a second locking portion, the first locking portion and the second locking portion are located at two opposite sides of the locked portion and clamp the locked portion along the lateral direction, the operating component comprises a first operating component and a second operating component, the first operating component and the first locking portion are located at a same side, the second operating component and the second locking portion are located at another same side, the first operating component is configured to cooperate with the second locking portion, the second operating component is configured to cooperate with the first locking portion, and the first operating component and the second operating component respectively deform the second locking portion and the first locking portion for disengaging the first locking portion and the second locking portion from the locked portion during the sliding movement of the operating component relative to the second buckle component.

16. The buckle assembly of claim 15, wherein the first locking portion comprises a first resilient arm and a first locking head connected to the first resilient arm, the first resilient arm is configured to cooperate with the second operating component, the first locking head is configured to engage with the locked portion, the first resilient arm is biased to engage the first locking head with the locked portion, the second operating component is configured to resiliently deform the first resilient arm for disengaging the first locking head from the locked portion, the second locking portion comprises a second resilient arm and a second locking head connected to the second resilient arm, the second resilient arm is configured to cooperate with the first operating component, the second locking head is configured to engage with the locked portion, the second resilient arm is biased to engage the second locking head with the locked portion, and the first operating component is configured to resiliently deform the second resilient arm for disengaging the second locking head from the locked portion.

17. The buckle assembly of claim 16, wherein the first operating component is slidable relative to the second buckle component along the lateral direction, a first abutting portion protrudes from the first operating component along the lateral direction, a second cooperating portion is formed on a free end of the second resilient arm and for cooperating with the first abutting portion, the first operating component abuts against the second cooperating portion by the first abutting portion to resiliently deform the second resilient arm for disengaging the second locking head from the locked portion during a sliding movement of the first operating component relative to the second buckle component, the second operating component is slidable relative to the second buckle component along the lateral direction, a second abutting portion protrudes from the second operating component along the lateral direction, a first cooperating portion is formed on a free end of the first resilient arm and for cooperating with the second abutting portion, and the second operating component abuts against the first cooperating portion by the second abutting portion to resiliently deform the first resilient arm for disengaging the first locking head from the locked portion during a sliding movement of the second operating component relative to the second buckle component.

18. The buckle assembly of claim 17, wherein the first cooperating portion is aligned with the second abutting portion along the lateral direction, and the second cooperating portion is aligned with the first abutting portion along the lateral direction.

19. The buckle assembly of claim 18, wherein the first locking head protrudes from an inner wall of the first resilient arm along the lateral direction, the first cooperating portion is adjacent to the first locking head, the second locking head protrudes from an inner wall of the second resilient arm along the lateral direction, and the second cooperating portion is adjacent to the first locking head.

20. The buckle assembly of claim 19, wherein the first locking head and the first cooperating portion are sequentially arranged along a direction from a fixing end of the first resilient arm to the free end of the first resilient arm, and the second locking head and the second cooperating portion are sequentially arranged along a direction from a fixing end of the second resilient arm to the free end of the second resilient arm.

21. The buckle assembly of claim 17, wherein the first cooperating portion and the second cooperating portion are located at different levels along an up-down direction of the buckle assembly, and the first abutting portion and the second abutting portion are located at different levels along the up-down direction.

22. The buckle assembly of claim 17, wherein the first cooperating portion is misaligned with the second cooperating portion along the lateral direction, and the first abutting portion is misaligned with the second abutting portion along the lateral direction.

23. The buckle assembly of claim 1, wherein a first embedding chamber is formed on the first buckle component, a second embedding chamber is formed on the second buckle component, the first magnetic structure is embedded into the first embedding chamber, and the second magnetic structure is embedded into the second embedding chamber.

24. The buckle assembly of claim 23, wherein the first embedding chamber is aligned with the second embedding chamber along the mating direction.

25. The buckle assembly of claim 1, wherein a restraining protrusion protrudes from the operating component, the second buckle component comprises a restraining block for cooperating with the restraining protrusion, and the second buckle component blocks the operating component by abutment of the restraining block and the restraining protrusion for preventing disengagement of the operating component and the second buckle component.

26. The buckle assembly of claim 1, wherein the locking portion comprises a first locking portion and a second locking portion, the first locking portion and the second locking portion are located at two opposite sides of the locked portion and clamp the locked portion along the lateral direction, the first locking portion comprises a first rotating arm, a first locking head and a first recovering component, the first rotating arm is pivotally connected to the second buckle component, the first locking head is connected to the first rotating arm and for engaging with the locked portion, the first locking head protrudes from an inner wall of the first rotating arm along the lateral direction, the first recovering component is disposed between the first rotating arm and the second buckle component and for biasing the first rotating arm to rotate to engage the first locking head with the locked portion, the second locking portion comprises a second rotating arm, a second locking head and a second recovering component, the second rotating arm is pivotally connected to the second buckle component, the second locking head is connected to the second rotating arm and for engaging with the locked portion, the second locking head protrudes from an inner wall of the second rotating arm along the lateral direction, and the second recovering component is disposed between the second rotating arm and the second buckle component and for biasing the second rotating arm to rotate to engage the second locking head with the locked portion.

27. The buckle assembly of claim 26, wherein the operating component comprises a first operating component and a second operating component, the first operating component and the first locking portion are located at a same side, the second operating component and the second locking portion are located at another same side, the first operating component and the second operating component are slidable relative to the second buckle component along the lateral direction, a first abutting portion protrudes from the first operating component along the lateral direction, a second cooperating portion is formed on the second rotating arm and for cooperating with the first abutting portion, the second cooperating portion is aligned with the first abutting portion along the lateral direction, the first operating component drives the second rotating arm to rotate by abutment of the first abutting portion and the second cooperating portion for disengaging the second locking head from the locked portion during a sliding movement of the first operating component, a second abutting portion protrudes from the second operating component along the lateral direction, a first cooperating portion is formed on the first rotating arm and for cooperating with the second abutting portion, the first cooperating portion is aligned with the second abutting portion along the lateral direction, the second operating component drives the first rotating arm to rotate by abutment of the second abutting portion and the first cooperating portion for disengaging the first locking head from the locked portion during a sliding movement of the second operating component, the first cooperating portion and the second cooperating portion are located at different levels along an up-down direction of the buckle assembly, the first cooperating portion is misaligned with the second cooperating portion along the lateral direction, the first abutting portion and the second abutting portion are located at different levels along the up-down direction of the buckle assembly, and the first abutting portion is misaligned with the second abutting portion along the lateral direction.

28. The buckle assembly of claim 26, wherein the operating component is slidable relative to the second buckle component along an extending direction perpendicular to the lateral direction and the mating direction, a first abutting portion and a second abutting portion protrude from the operating component along the extending direction, a second cooperating portion is formed on the second rotating arm and for cooperating with the first abutting portion, the second cooperating portion is aligned with the first abutting portion along the extending direction, a first cooperating portion is formed on the first rotating arm and for cooperating with the second abutting portion, the first cooperating portion is aligned with the second abutting portion along the extending direction, and the operating component drives the first rotating arm and the second rotating arm to rotate by abutment of the second abutting portion and the first cooperating portion and abutment of the first abutting portion and the second cooperating portion for disengaging the first locking head and the second locking head from the locked portion during the sliding movement of the operating component.

29. The buckle assembly of claim 26, wherein the operating component is slidable relative to the second buckle component along the mating direction, a first abutting portion and a second abutting portion protrude from the operating component along the mating direction, a second cooperating portion is formed on the second rotating arm and for cooperating with the first abutting portion, the second cooperating portion is aligned with the first abutting portion along the mating direction, a first cooperating portion is formed on the first rotating arm and for cooperating with the second abutting portion, the first cooperating portion is aligned with the second abutting portion along the mating direction, and the operating component drives the first rotating arm and the second rotating arm to rotate by abutment of the second abutting portion and the first cooperating portion and abutment of the first abutting portion and the second cooperating portion for disengaging the first locking head and the second locking head from the locked portion during the sliding movement of the operating component.

30. The buckle assembly of claim 1, wherein the operating component is established by a separate body from a body that establishes the locking portion.

31. The buckle assembly of claim 1, wherein the buckle assembly is constructed so that the operating component is completely removable from the buckle assembly while the locking portion remains with the buckle assembly.

32. The buckle assembly of claim 1, wherein operation of the operating component drives the locking portion in a general direction that is the same as a direction of operation of the operating component.

33. The buckle assembly of claim 1, wherein the operating component is resiliently biased outward of the second buckle component by a resilient arm that is a separate body from a body establishing the operating component.

34. The buckle assembly of claim 1, wherein the locking portion is rotatable relative to the second buckle component and the operating component.

35. The buckle assembly of claim 1, wherein cooperation of the operating component with the locking portion is by contact between respective surfaces of the locking portion and the operating component.

36. A buckle assembly comprising:

a first buckle component comprising a locked portion;

a second buckle component comprising a locking portion configured to cooperate with the locked portion, the locking portion engaging with the locked portion along a lateral direction of the buckle assembly when the second buckle component is mated with the first buckle component along a mating direction; and an operating component partially embedded in the second buckle component and partially exposed out of the second buckle component, the operating component being configured to cooperate with the locking portion and slidable relative to the locking portion, the operating component driving the locking portion to move away from the locked portion for disengaging the locking portion from the locked portion during a sliding movement of the operating component relative to the locking portion;

wherein the buckle assembly is configured so that the operating component slides against the locking portion when the operating component is moved relative to a remainder of the second buckle component.

37. A buckle assembly comprising: a first buckle component comprising a locked portion; a second buckle component comprising a locking portion configured to cooperate with the locked portion, the locking portion engaging with the locked portion along a lateral direction of the buckle assembly when the second buckle component is mated with the first buckle component along a mating direction; and an operating component partially embedded in the second buckle component and partially exposed out of the second buckle component, the operating component being configured to cooperate with the locking portion and slidable relative to the second buckle component, the operating component driving the locking portion to move away from the locked portion for disengaging the locking portion from the locked portion during a sliding movement of the operating component relative to the second buckle component, and further comprising a resilient component disposed between the operating component and the second buckle component and for biasing the operating component to slide away from the locking portion.

38. The buckle assembly of claim 37, wherein a C-shaped structure is formed on the second buckle component and for accommodating the resilient component.

39. The buckle assembly of claim 37, wherein the operating component is configured to cooperate with the locking portion and slidable relative to the locking portion.

40. A buckle assembly comprising: a first buckle component comprising a locked portion; a second buckle component comprising a locking portion configured to cooperate with the locked portion, the locking portion engaging with the locked portion along a lateral direction of the buckle assembly when the second buckle component is mated with the first buckle component along a mating direction; and an operating component partially embedded in the second buckle component and partially exposed out of the second buckle component, the operating component being configured to cooperate with the locking portion and slidable relative to the second buckle component, the operating component driving the locking portion to move away from the locked portion for disengaging the locking portion from the locked portion during a sliding movement of the operating component relative to the second buckle component, and wherein the locking portion comprises a rotating arm, a locking head and a recovering component, the rotating arm is pivotally connected to the second buckle component, the locking head is connected to the rotating arm and for engaging with the locked portion, the operating component is configured to drive the rotating arm to rotate for disengaging the locking head from the locked portion, and the recovering component is disposed between the rotating arm and the second buckle component and for biasing the rotating arm to rotate to engage the locking head with the locked portion.

41. The buckle assembly of claim 40, wherein the operating component is slidable relative to the second buckle component along the lateral direction, an abutting portion protrudes from the operating component along the lateral direction, a cooperating portion is formed on the rotating arm and for cooperating with the abutting portion, the cooperating portion is aligned with the abutting portion along the lateral direction, and the operating component drives the rotating arm to rotate by abutment of the abutting portion and the cooperating portion for disengaging the locking head from the locked portion during the sliding movement of the operating component relative to the second buckle component.

42. The buckle assembly of claim 40, wherein the operating component is slidable relative to the second buckle component along an extending direction perpendicular to the lateral direction and the mating direction, an abutting portion protrudes from the operating component along the extending direction, a cooperating portion is formed on the rotating arm and for cooperating with the abutting portion, the cooperating portion is aligned with the abutting portion along the mating direction, and the operating component drives the rotating arm to rotate by abutment of the abutting portion and the cooperating portion for disengaging the locking head from the locked portion during the sliding movement of the operating component.

43. The buckle assembly claim 40, wherein the operating component is slidable relative to the second buckle component along the mating direction, an abutting portion protrudes from the operating component along the mating direction, a cooperating portion is formed on the rotating arm and for cooperating with the abutting portion, the cooperating portion is aligned with the abutting portion along the mating direction, and the operating component drives the rotating arm to rotate by abutment of the abutting portion and the cooperating portion for disengaging the locking head from the locked portion during the sliding movement of the operating component.

44. The buckle assembly of claim 40, wherein the operating component is configured to cooperate with the locking portion and slidable relative to the locking portion.

* * * * *